US005905927A

United States Patent [19]

Inoue et al.

[11] Patent Number: 5,905,927

[45] Date of Patent: May 18, 1999

[54] IMAGE FORMING APPARATUS AND DRIVING MECHANISM FOR IMAGE HOLDING MEMBER

[75] Inventors: Yoshinori Inoue; Masanori Murakami, both of Toyohashi; Jinju Okuno, Toyokawa; Masanori Yamamoto, Toyokawa; Shinya Sakanashi, Toyokawa; Takeshi Hamada, Toyokawa, all of Japan

[73] Assignee: Minolta Co., Ltd., Osaka, Japan

[21] Appl. No.: 08/982,404

[22] Filed: Dec. 2, 1997

[30] Foreign Application Priority Data

| | | | |
|---|---|---|---|
| Dec. 3, 1996 | [JP] | Japan | 8-322629 |
| Dec. 11, 1996 | [JP] | Japan | 8-331033 |
| Dec. 12, 1996 | [JP] | Japan | 8-331906 |

[51] Int. Cl.[6] ..... G03G 15/00

[52] U.S. Cl. ..... 399/167; 74/665 GA; 74/665 GD; 74/665 GE; 464/157

[58] Field of Search ..... 399/167, 117; 74/665 GA, 665 G, 665 GB, 665 GC, 665 GD, 665 GE; 464/147, 157

[56] References Cited

U.S. PATENT DOCUMENTS

| | | | |
|---|---|---|---|
| 5,528,960 | 6/1996 | Nagao et al. | 74/665 GD |
| 5,708,933 | 1/1998 | Nogami et al. | 399/167 |
| 5,761,580 | 6/1998 | Harada et al. | 399/167 |

FOREIGN PATENT DOCUMENTS

| | | |
|---|---|---|
| 04136868 | 5/1992 | Japan . |
| 06011016 | 1/1994 | Japan . |

*Primary Examiner*—Richard Moses

*Attorney, Agent, or Firm*—McDermott, Will & Emery

[57] ABSTRACT

In order to provide a driving mechanism for a photosensitive drum which is capable of reducing deformation of the shaft of the photosensitive drum caused by loads when transmitting a driving force, a drive transmission course 51 is diverged to at least two courses in a drive transmission system 42 for transmitting the drive force from a drive motor 41 to the photosensitive drum 25. Specifically, the last stage of the drive transmission course 51 is engaged with a passive member 47 provided to the drum shaft 25*a* at two or more points to connect and link the drive force, thereby diverging the directions of loads to several directions, by which irregular movements of the photosensitive drum or vibration caused by the deformation of the shaft is eliminated.

44 Claims, 19 Drawing Sheets

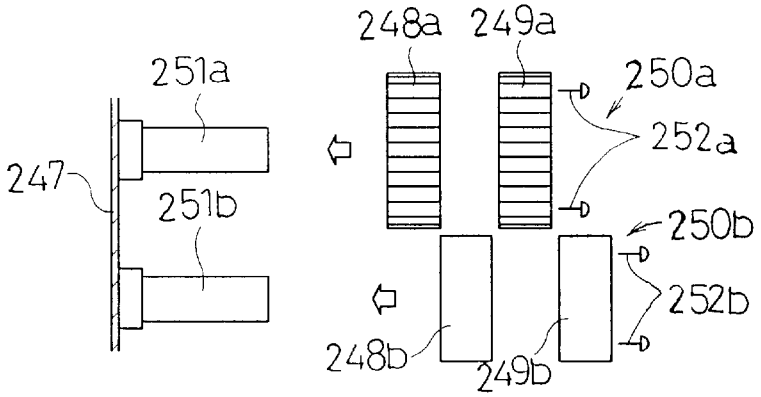
Fig. 20A
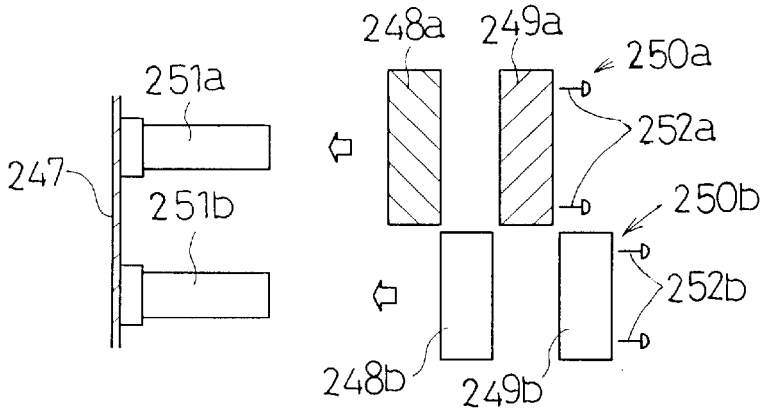
Fig. 20B
Fig. 21A Fig. 21B Fig. 21C
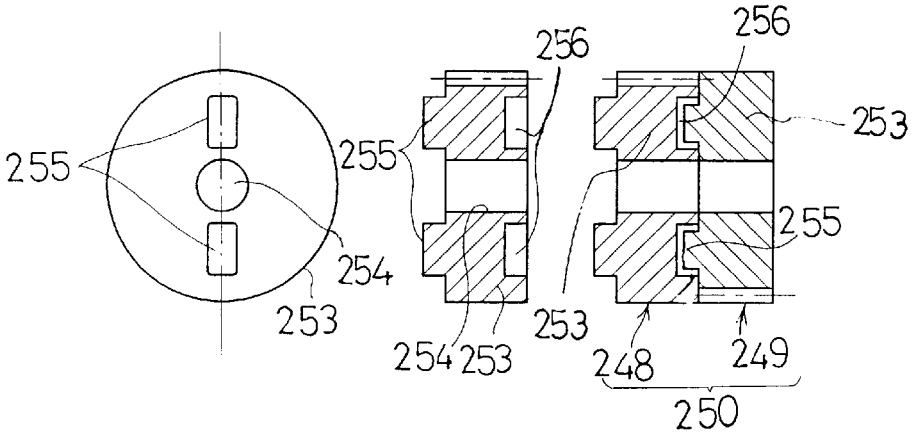

Fig. 22A
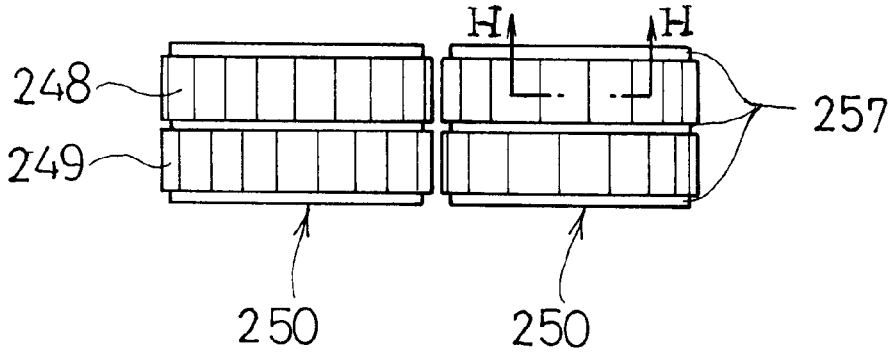
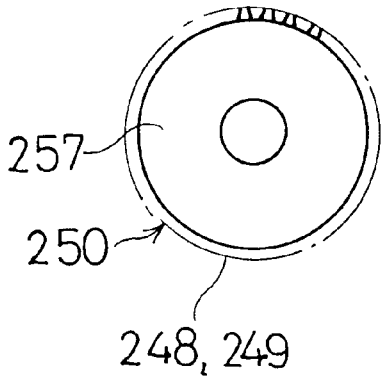
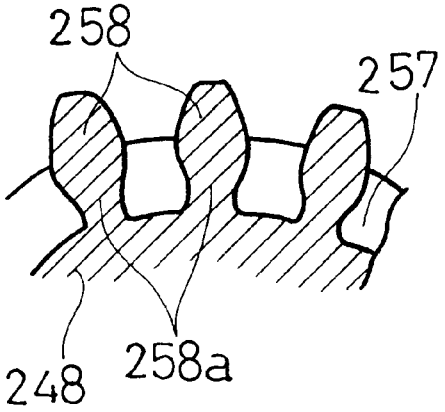
Fig. 22B
Fig. 22C

Fig. 23A
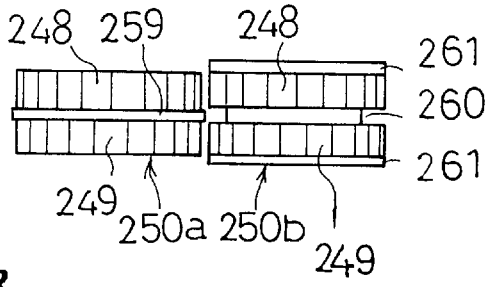
Fig. 23B
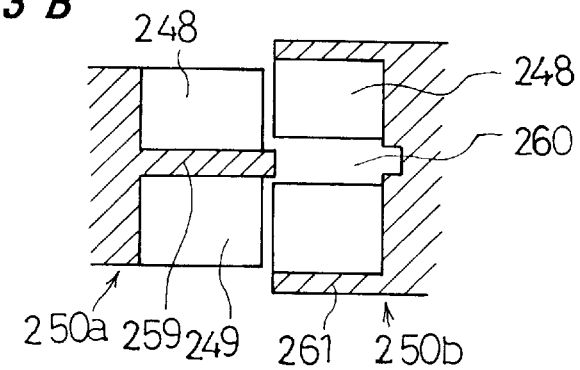
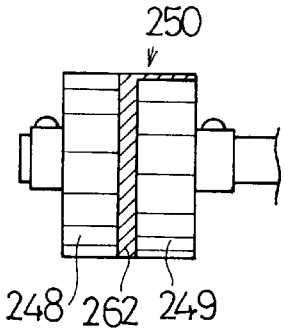
Fig. 24A
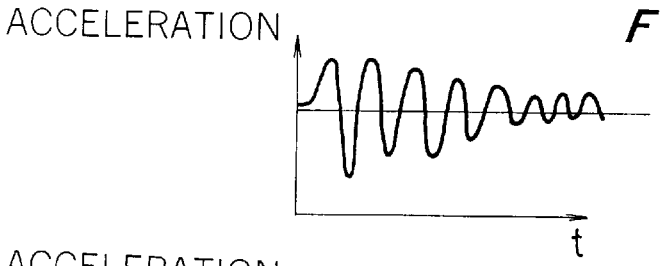
Fig. 24B
Prior Art
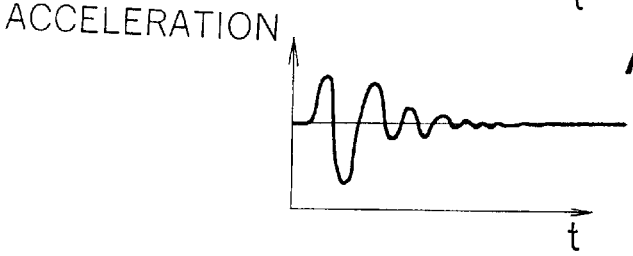
Fig. 24C

IMAGE FORMING APPARATUS AND DRIVING MECHANISM FOR IMAGE HOLDING MEMBER

BACKGROUND OF THE INVENTION

1. Technical Field of the Invention

The present invention relates to an image forming apparatus and a driving mechanism for a latent image holding member thereof such as a photosensitive drum, on which an electrostatic latent image is formed by image exposing, which is then developed and transferred to a transfer material.

2. Description of Related Art

Image forming apparatuses which form an image in a manner described above include a facsimile machine, copying machine, printer and other various appliances. In such image forming apparatuses, a latent image is formed on the latent image holding member (photosensitive drum) by exposing it with a laser beam or a light reflected from an original. As for the driving mechanism regarding such image formation, it is desired to drive the photosensitive drum to evenly rotate as its basic function, because irregularity in rotation of the photosensitive drum when exposing the image causes unevenness in pitches of the image and adversely affects the quality of the image. Such effects are more notable in a digital exposure by a laser beam. Further, for forming a color image by superimposing a plurality of images, irregular rotation of the drum causes a severer problem as each color image cannot be accurately registered.

Conventionally, it has been devised to reduce the variation in speed of the driving mechanism in a rotational direction in order to decrease irregularity in rotating movements of the photosensitive drum.

In a general method of driving a photosensitive drum, a drive force is usually transmitted to only one end of the photosensitive drum. This causes deflection of the drum shaft by a load exerted in one direction to one end of the drum, generating a frictional force in the bearing which is the sources of irregular rotation of the drum. The vibration of the shaft is also the cause of the adverse effects to image formation on the photosensitive drum.

The problem caused by the deformation of the shaft may be countered by shortening the length of the shaft, increasing the diameter of the shaft, or reducing the load to the shaft, any of which has though only limited effects due to the restrictions in designs.

It is also assumed that the irregular rotation is ascribable to the impact when the gears come to engagement which generates vibration, as well as the vibration generated in every one cycle of rotation caused by eccentricity of the gears. Conventionally, it has been tried to reduce such components of vibration by increasing the accuracy in dimension of the gears or by providing a flywheel to the drum shaft.

Also a known method is providing a brake to the drum and controlling the torque of the brake. FIG. 1 shows one example of a conventional apparatus for such brake controlling method. A stepping motor 81 is driven by a motor drive circuit 83 according to the commands from a motor controlling circuit 82. The motor drive circuit 83 is connected to a load measuring circuit 84 by which the variation in loads to the stepping motor 81 is continuously measured. A photosensitive drum 85 is driven by the stepping motor 81 via a gear system 86, and is provided with an electromagnetic brake 87 at one extended end of a rotating shaft 85*a* thereof. Load measuring signals are transmitted from the load measuring circuit 84 to a brake controlling circuit 88 based on which the electromagnetic brake 87 is controlled via a brake driver 89 by feedback control. In this prior art apparatus, when the gear system 86 is made eccentric by a cleaner blade (not shown) or the like contacting with the drum 85, causing variation $T_1$ in the load to the drum as shown in FIG. 2, the drive torque T applied by the stepping motor 81 is stabilized to be a fixed rate $T_0$ by applying biased torque with the electromagnetic brake 87 in accordance with the amount of variation $T_1$. More specifically, the torque T applied by the electromagnetic brake 87 is augmented as shown in FIG. 3 by increasing the electric current I supplied to the electromagnetic brake 87 when the load is decreased ($T_a$ as shown in FIG. 2). Conversely, when the load is increased ($T_b$ in FIG. 2), the electric current I is less applied to the electromagnetic brake 87 in order to reduce the torque T.

As the demand for quality of image has been sharply increased, these problems as described above cannot be any more solved by fabricating the gears more precisely in dimension, due to the limits of machining capacity. The impact generated by engagement between the gears or the vibration generated in every cycle of rotation can be reduced by providing a flywheel to the drum shaft. However, this has no effects at a low frequency area where the additional flywheel causes resonance.

As for the brake controlling method, a follow-up control of an electromagnetic brake provided to the photosensitive drum can be made at the low frequency area but not at the high frequency area. This is because the vibration caused by the engaging actions of the gears at the high frequency area cannot be eliminated with feed back control which has an inevitable time lag. Also, such a complicated control causes the increase in production cost of apparatus.

BRIEF SUMMARY OF THE INVENTION

In view of the foregoing, an object of the present invention is to provide an improved image forming apparatus and a driving mechanism for an image holding member which solves the above described problems, and to provide an image forming apparatus and a driving mechanism for an image holding member such as a photosensitive drum thereof which is capable of forming an image in favorable conditions by reducing irregularity in rotating movements of the photosensitive drum.

To accomplish the above said object, the driving mechanism for rotating an image holding member such as a photosensitive drum according to the present invention comprises: a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member.

According to such arrangement, the direction of load exerted to the rotating shaft of the image holding member is diverted to a plurality of directions by dividing the drive transmission course into two or more courses, each of which is engaged with the receiving member at the last stages thereof, thereby eliminating irregularity in rotation caused by a frictional force in the bearing or vibration caused by the deflection of the shaft. By having several points of engagement, the load is also diverged to each engaging point, reducing variation of each load and thus decreasing the vibration in the circumferential direction, contributing to formation of a favorable image.

In order to accomplish the above said object, a driving mechanism for rotating an image holding member according to the present invention comprises: a drive source for driving the image holding member to rotate; a drive transmission system for transmitting a drive force from the drive source to the image holding member, including a first pair of gears comprised of a toothed wheel disposed on a rotating shaft of the image holding member and another toothed wheel engaged therewith; and a resistance giving mechanism for providing a resistance force to a rotation of the image holding member through a second pair of gears comprised of toothed wheels fabricated to have an identical configuration with that of the first pair of gears, wherein the toothed wheels of the second pair of gears are brought to engagement at a timing lagged by a given amount from that of the first pair of gears.

According to such arrangement, the vibration transmitted to the image holding member can be decreased, since the wave form of vibration generated in the drive transmission system and the wave form of vibration generated by rotation resistance are counterbalanced by shifting the phases of the gears corresponding to the time lag in the timing of engagement between the pair of gears.

Further, a driving mechanism for rotating an image holding member according to the present invention comprises: a drive source for driving the image holding member to rotate; a drive transmission system for transmitting a drive force from the drive source to the image holding member, including a first pair of gears comprised of a toothed wheel disposed on a rotating shaft of the image holding member and another toothed wheel engaged therewith; a first resistance giving mechanism for providing a resistance force to a rotation of the image holding member through a second pair of gears comprised of toothed wheels fabricated to have an identical configuration with that of the first pair of gears; and a second resistance giving mechanism for providing a resistance force to the rotation of the image holding member through a third pair of gears comprised of toothed wheels fabricated to have an identical configuration with that of the first pair of gears, wherein the toothed wheels of the second pair of gears are brought to engagement at a timing lagged by half a pitch from that of the first pair of gears, and the toothed wheels of the third pair of gears are brought to engagement at a timing lagged by 180 degrees from that of the first pair of gears.

The component of vibration caused by engaging actions of the toothed wheels is reduced by arranging the second pair of gears to have each toothed wheel shifted by a half pitch in engagement as compared with the first pair of gear, as well as the component of vibration generated in every cycle of rotation of the image holding member is reduced by arranging the engagement between the toothed wheels of the third pair of gears to be delayed by 180 degrees as compared with that of the first pair of gears.

Also, a driving mechanism for rotating an image holding member according to the present invention comprises: a drive source for driving the image holding member to rotate; a drive transmission system for transmitting a drive force from the drive source to the image holding member, including a pair of gears comprised of a first gear member consisting of two toothed wheels coaxially combined together with their teeth shifted by half a pitch in relation to each other and a second gear member consisting of two toothed wheels respectively engaged with the two toothed wheels of the first gear member and being coaxially combined together with their teeth shifted by half a pitch in relation to each other.

The two gear members in the drive transmission system come to engagement with each other by half a pitch, thereby reducing the changes in rigidity of the teeth thus decreasing the vibration caused by the engaging action.

Other and further objects, features and advantages of the invention will appear more fully from the following description.

BRIEF DESCRIPTION OF THE DRAWINGS

FIG. 20A shows a first exemplary arrangement of a gear member comprised of spur wheels, and FIG. 20B shows an exemplary arrangement of the same comprised of helical gears;

FIG. 21A is a plan view of one toothed wheel, FIG. 21B is a longitudinal sectional side elevation view thereof, and FIG. 21C is a longitudinal sectional side elevation view showing a gear member comprised of two toothed wheels, all illustrating a second exemplary arrangement of a gear member;

FIG. 22A is a front view of a pair of gear members, FIG. 22B is a plan view of one gear member, and FIG. 22C is a sectional view taken in the directions of the arrows along the line H—H in FIG. 22A, all showing a third exemplary arrangement of a gear member;

FIG. 23A is a front view showing a pair of gear members, and FIG. 23B is an enlarged sectional view showing the gear members in a disengaged state, both illustrating a fourth exemplary arrangement of a gear member; and FIG. 24A is a side elevation view showing a fifth exemplary arrangement of a gear member, and FIGS. 24B and 24C show the decrement of vibration at the teeth of the toothed wheels when a damping member is provided and not provided.

DETAILED DESCRIPTION OF THE PREFERRED EMBODIMENTS

First Embodiment

A first embodiment of the present invention will be hereinafter described in the form of a driving mechanism for a photosensitive drum incorporated in a laser beam printer referring to FIGS. 4 and 5.

Figure 1:
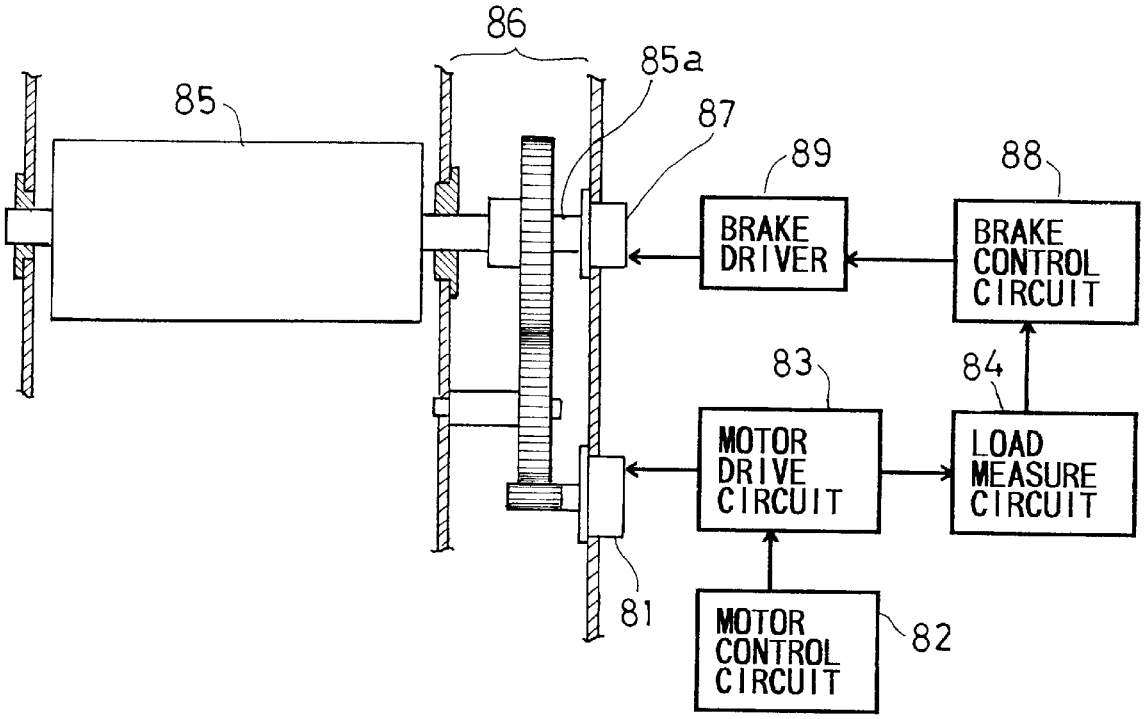
Fig. 1 Prior Art
FIG. 1 is a plan view showing a schematic structure of a printer having a conventional driving system for photosensitive drum with a block diagram of a controlling system.
Figure 2:
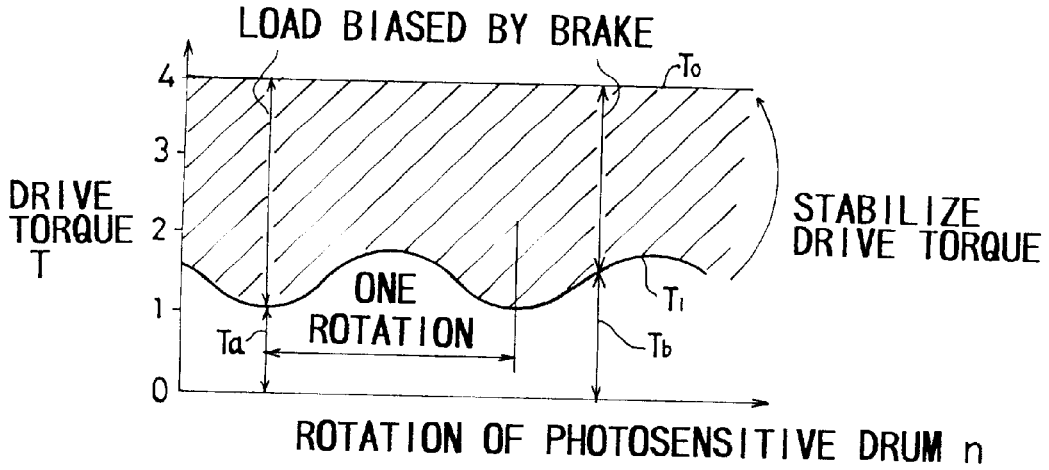
Fig. 2 Prior Art
FIG. 2 is an explanatory view showing brake characteristics in the conventional driving system for photosensitive drum in the printer.
Figure 3:
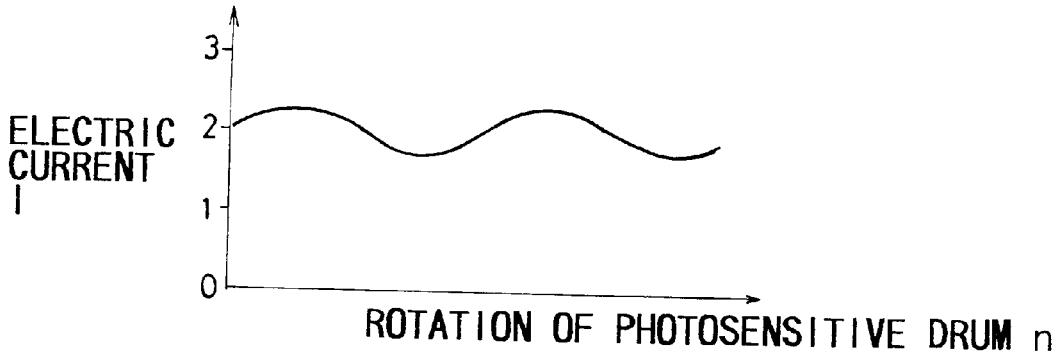
Fig. 3 Prior Art
FIG. 3 is an explanatory view showing a brake action in the conventional driving system for photosensitive drum in the printer.
Figure 4:
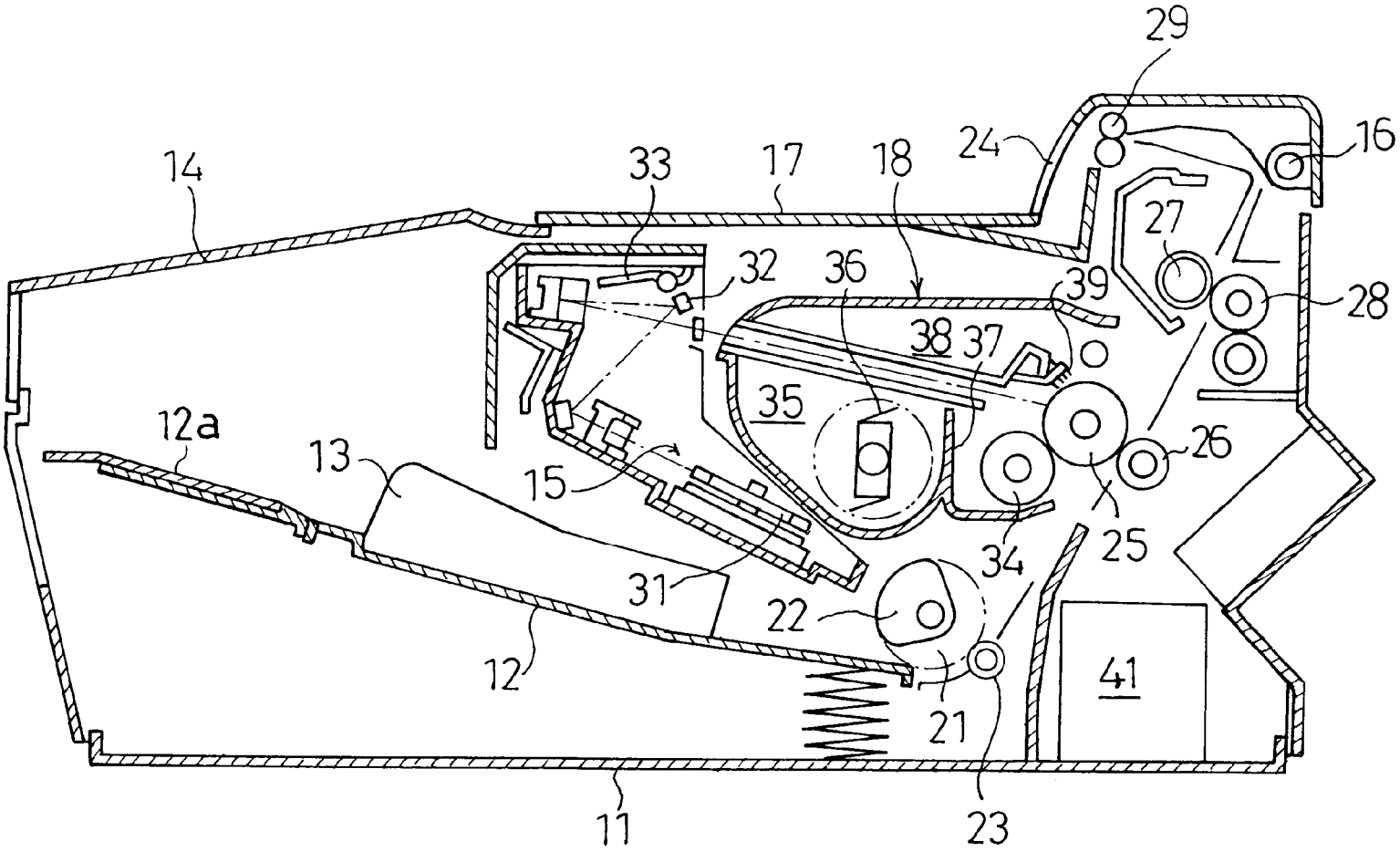
FIG. 4 is a schematic view showing a configuration of a laser beam printer, in which a driving mechanism for photosensitive drum according to one embodiment of the present invention is incorporated.

A machine body 11 of the laser beam printer of this embodiment shown in FIG. 4 has its front on the left hand side of the figure. A sheet tray 12 is built in at the bottom side in the machine body 11 in such a way that it is tilted downwardly toward the back side of the machine body 11. Recording sheets are loaded in a pile on the sheet tray 12. The tip 12*a* of the sheet tray 12 can be projected outside the machine body 11 so as to be able to hold relatively longer recording sheets such as legal-sized paper thereon.

In order to control the widthwise position of the recording sheets, a width restriction plate 13 is provided to the sheet tray 12. A front cover 14 is mounted to the machine body 11, which can be opened so as to facilitate the loading of the recording sheets on the sheet tray 12.

The laser beam scanning optical system 15 is disposed substantially at the center of the machine body 11. The top side of the printer is a cover 17 which is connected to the back end of the machine body 11 at its back side by a hinge 16 which rotatably supports the cover 17 to enable it to be opened and closed, thus being a clam shell structure. An image forming cartridge 18 is loaded under the cover 17, which can be mounted and dismounted by opening the cover 17.

Recording sheets piled on the sheet tray 12 are fed out one by one through a feeding roller 21 with a cam 22 and a pinch roller 23 being contacted therewith, guided toward an image forming section, formed an image thereon at the image forming section and discharged onto the cover 17 toward the front side of the printer through an opening 24 provided in the cover 17.

The image is formed on the recording sheets by transferring a toner image formed on a photosensitive drum 25 (photosensitive member) in the cartridge 18 with a transfer roller 26 disposed in the machine body 11, and by fixing the transferred image by heat adhesion with a pair of fixing rollers 27, 28. Inside the opening 24 is a pair of discharge rollers 29, 29 to ensure the discharge of the sheets outside the machine body 11 after the image formation.

The laser beam scanning optical system 15 comprises a polygon mirror 31, to which a light is beamed from a light source consisting of a semiconductor laser and a collimation lens, and other known elements such as a reflection mirror 32 or the like. A shutter 33 is rotatably mounted in the optical system 15 which reveals the mirror 32 when the image forming cartridge 18 is loaded in its proper position as shown in FIG. 4, and shuts the mirror 32 when the cover 17 is opened. Such movements of the shutter 33 are carried out by an element which is not shown in the figure, linking with the opening/closing operations of the cover 17.

A laser beam modulated according to the image signals is beamed onto the photosensitive drum 25 in the image forming cartridge 18 from the optical system 15 to expose an image into an electrostatic latent image.

Adjacent to the photosensitive drum 25 in the image forming cartridge 18 is a developing sleeve 34, to which toner particles encased in a toner tank 35 are supplied by rotation of a blade member 36 through apertures made in a wall 37.

The developing sleeve 34 develops an electrostatic latent image formed on the photosensitive drum 25 with the provided toner into a visible toner image, which is then transferred on to the recording sheets by the transfer roller 26. Residual toner particles left on the surface of the photosensitive drum 25 after image transfer are removed by a cleaning blade (not shown) and recovered in a tank 38 for toner waste positioned at an upper side in the image forming cartridge 18.

The surface of the photosensitive drum 25 is charged with an appropriate electric potential to form an electrostatic latent image thereon by a charging brush 39 contacted thereto. The image forming cartridge 18 of such configuration as described above is mentioned as "an image cartridge" or "a process cartridge", and is replaced with a new one when the life of the photosensitive drum 25 has terminated or the toner has been used up.

Figure 5A:
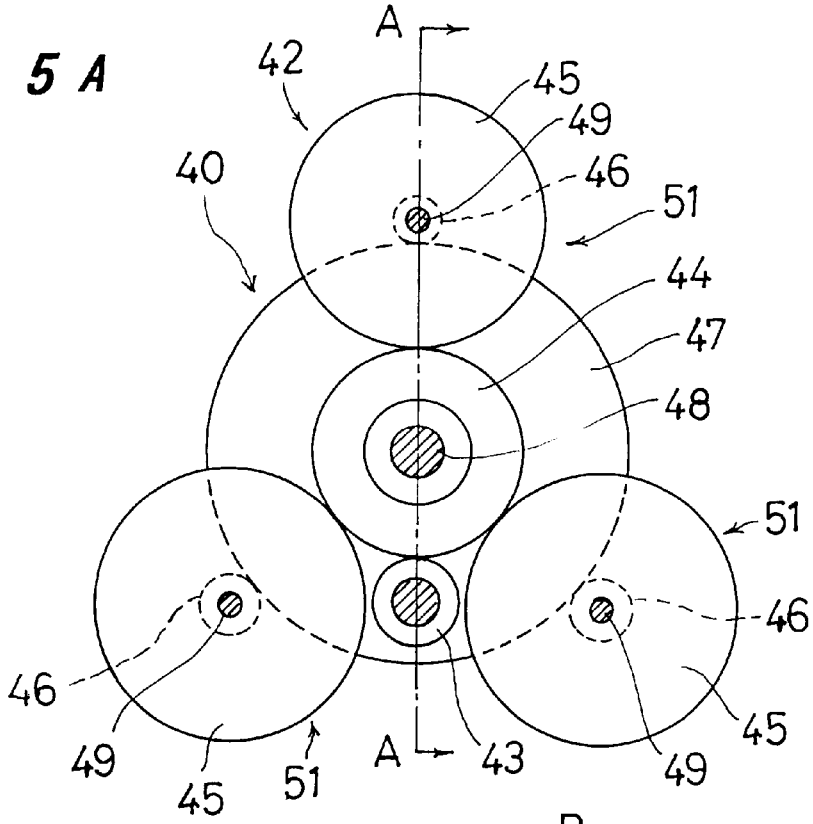
FIG. 5A is a plan view taken in the direction of the arrows along the line B—B of FIG. 5B.
Figure 5B:
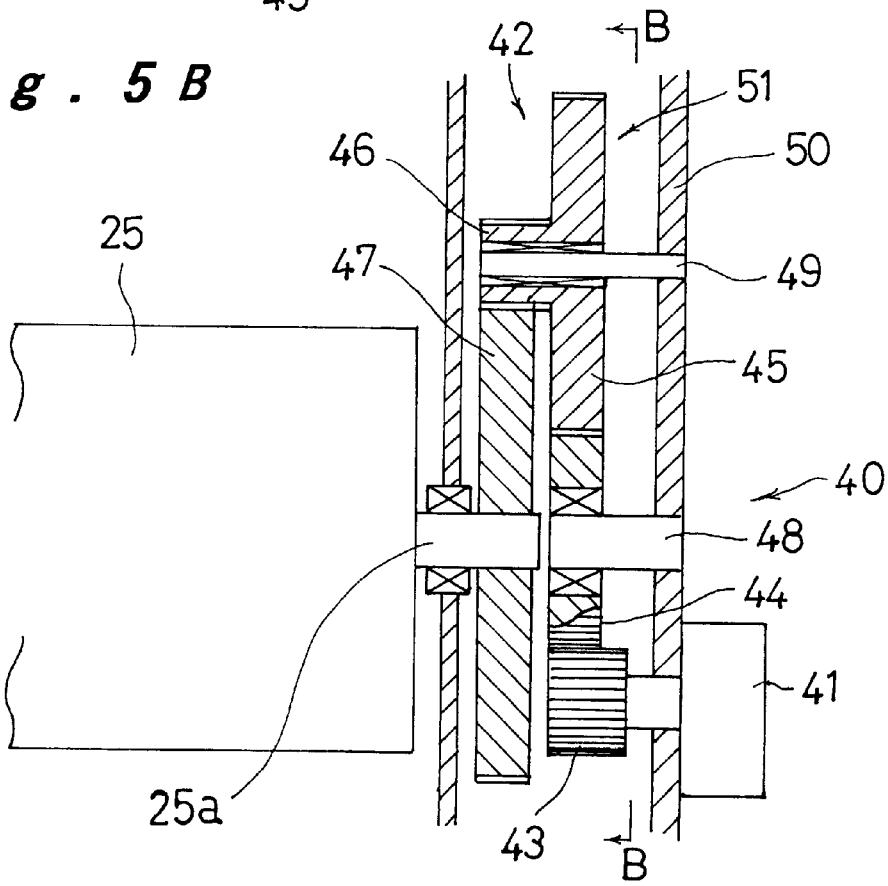
FIG. 5B is a longitudinal sectional side elevation view taken in the direction of the arrows along the line A—A of FIG. 5A, both showing a schematic structure of the driving mechanism according to a first embodiment of the present invention.

In a printer constructed as described above, the photosensitive drum 25 is driven by a driving mechanism 40 as shown in FIGS. 5A and 5B. The driving mechanism 40 transmits a drive force from a driving motor 41 via a drive transmission system 42 to the photosensitive drum 25. The drive transmission system 42 comprises a series of toothed wheels including a drive gear 43 fixed to the shaft of the drive motor 41, a center gear 44 disposed coaxially with the axial center of the photosensitive drum 25 and engaged with the drive gear 43, three first transmission gears 45 disposed circumferentially at an equal distance and engaged with the center gear 44, three second transmission gears 46 uniformly provided to each of the first transmission gears 45, and a driven gear 47 connected to a cam shaft 25*a* of the photosensitive drum 25 and engaged with the second transmission gears 46. A support shaft 48 rotatably supports the center gear 44 and a support shaft 49 supports the first and second transmission gears 45, 46 to be freely rotated, both shafts being horizontally projected from a side plate 50 of the machine body 11. A drive transmission course 51 is so constituted that it is diverged from the center gear 44 as a central transmission means to the first and second transmission gears 45, 46, each provided in three, and that the last stage of the drive transmission course 51, which is the second transmission gears 46, are respectively engaged with the driven gear 47 as a passive member to connect and link the drive force.

According to such arrangement, the direction of load to the drum shaft 25*a* is diverged to several directions because the second transmission gears 46 serving as the last stage of the drive transmission course 51 are engaged with the drive gear 47 fixed to the drum shaft 25*a* at three points. Uneven rotation caused by a frictional force between the drum shaft 25*a* and its bearing or vibration caused by deformation of the drum shaft 25*a* can be thereby decreased. At the same time, the load at each engaged point is decreased as the second transmission gears 46 are provided in plurality, reducing variation of each load and vibration in the circumferential direction.

Since the three second transmission gears 46 each engaged with the driven gear 47 are disposed at an equal distance around the axial center of the driven gear 47, loads at each engaging point counterbalance each other in a radial direction, positively preventing vibration in the radial direction. Further, by disposing the center gear 44 coaxially with the axial center of the photosensitive drum 25 and by diverging the drive transmission course 51 from this center gear 44, each of the diverged drive transmission courses 51 can be identically constructed, which helps even the effects of variation or vibration generated in each drive transmission course to further reduce the vibration.

As set forth above, according to the present invention, the vibration of the photosensitive drum 25 caused by deformation of the drive shaft 25*a* is eliminated, the vibration in the circumferential direction is reduced by decreasing the amount and the variation of loads at each transmission point, and the vibration in the radial direction is prevented by disposing each loaded point at an equal distance, whereby an image of favorable condition can be formed.

Second Embodiment

Figure 6A:
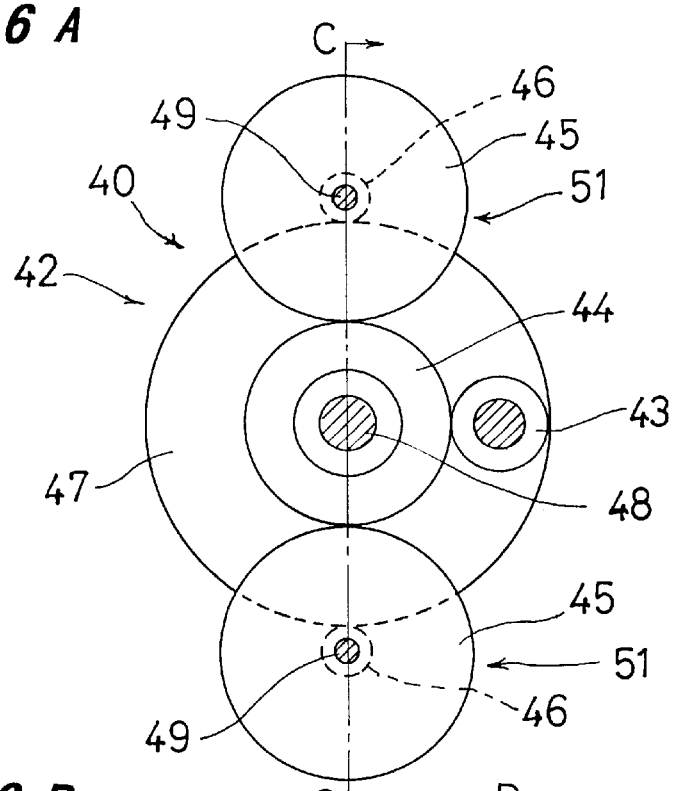
FIG. 6A is a plan view taken in the direction of the arrows along the line D—D of FIG. 6B.
Figure 6B:
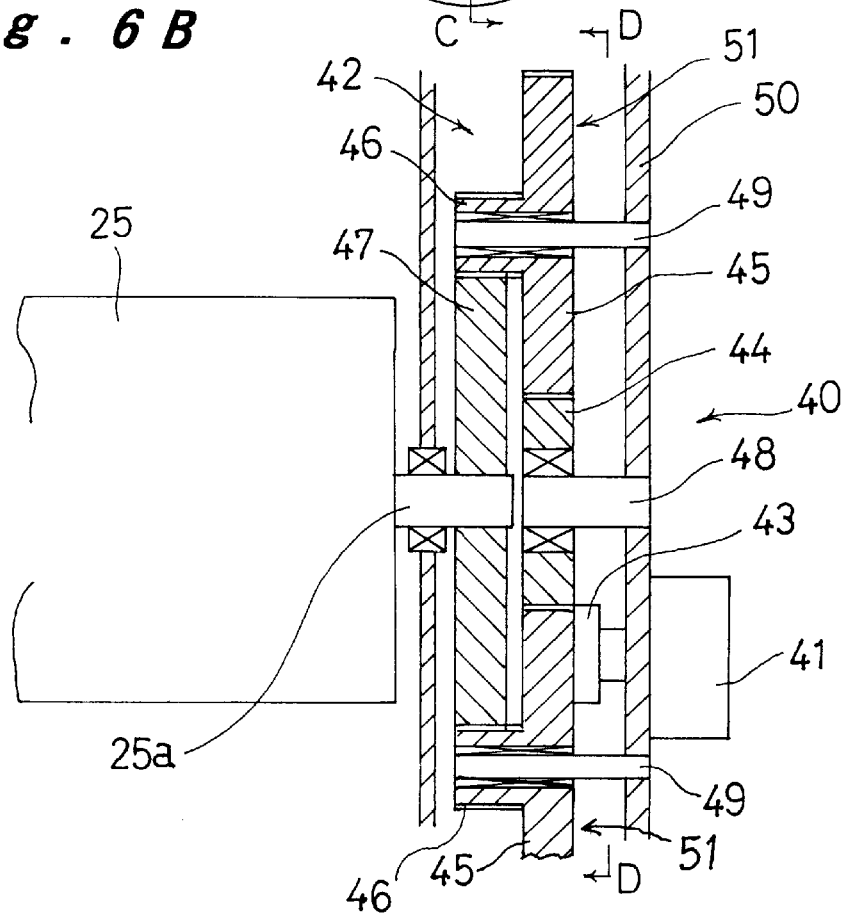
FIG. 6B is a longitudinal sectional side elevation view taken in the direction of the arrows along the line C—C of FIG. 6A, both showing a schematic structure of the driving mechanism according to a second embodiment of the present invention.

A second embodiment of the present invention will be described referring to FIGS. 6A and 6B. Unlike the first embodiment in which three drive transmission courses 51 are provided, the drive transmission course 51 in this embodiment is provided in a pair along a diametral direction of the center gear 44. Though the number of the diverged drive transmission courses 51 is fewer, the effects and advantages are substantially the same as those of the first embodiment. By fabricating the driven gears 47 with an odd number of teeth, each transmission gear 46 disposed on the diametral line of the driven gear 47 comes to engagement with the driven gear 47 at timings differed by half of the pitch. When the drive force is transmitted to the drive gear 47 via each drive transmission course 51, one frequency generated by the engagement of teeth is counterbalanced by another frequency staggered by a half pitch, contributing to even rotating movements of the photosensitive drum 25.

Third Embodiment

Figure 7:
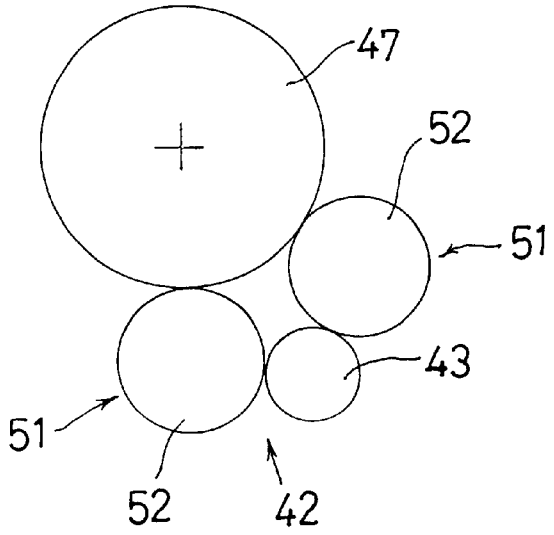
FIG. 7 is a plan view showing a schematic structure of the driving mechanism according to a third embodiment of the present invention.

FIG. 7 shows a third embodiment of the present invention. The drive transmission course 51 is diverted to two directions along the diameter of the center gear 44 in the second embodiment, while in this embodiment, the drive gear 43 is engaged with two transmission gears 52 which are then toothed with the driven gear 47, making a bifurcated drive transmission course 51.

This embodiment is further simplified in structure as compared with the second embodiment, and has the same effects and advantages mentioned in the description of the first embodiment by branching the drive transmission course 51.

Fourth Embodiment

Figure 8:
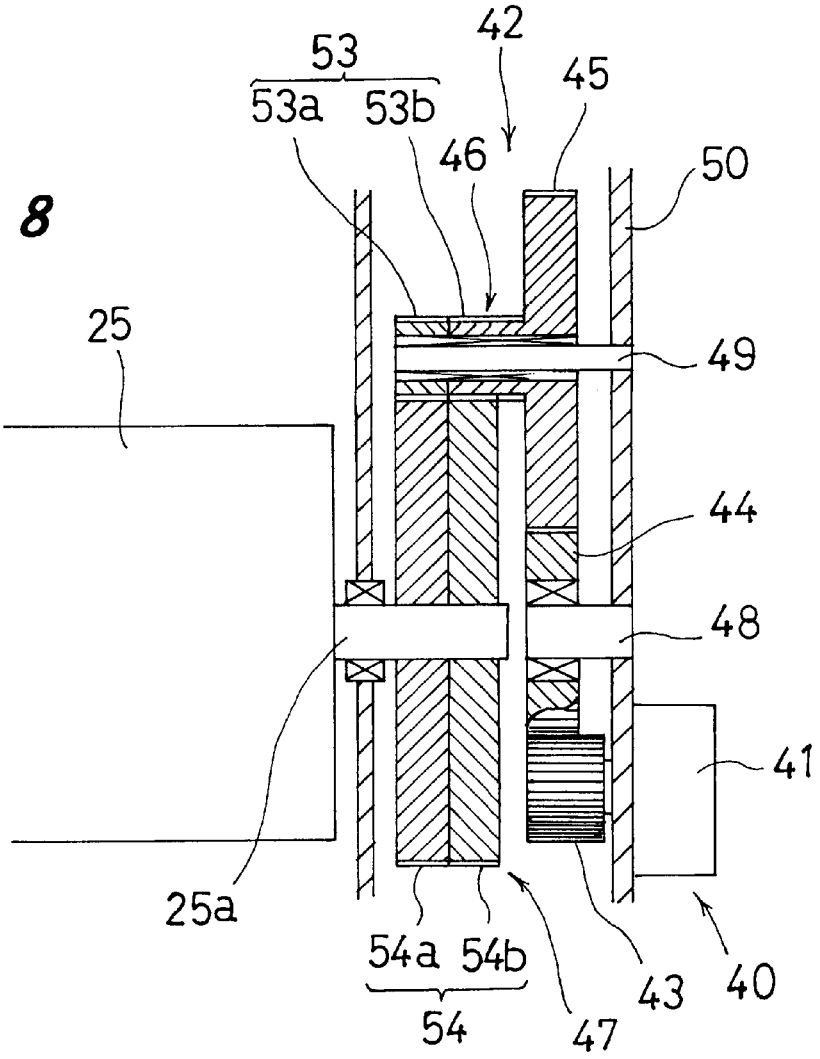
FIG. 8 is a longitudinal sectional side elevation view showing a schematic structure of the driving mechanism according to a fourth embodiment of the present invention.

FIG. 8 shows a fourth embodiment of the present invention, in which each of the driven gear 47 and the second transmission gear 46 is comprised of gear members 53, 54, which are respectively constituted with two toothed gears 53*a*, 53*b* and 54*a*, 54*b* combined with their phases of teeth shifted by a half pitch with each other.

By this arrangement, the variation of the tooth rigidity with the lapse of time due to the variation of the engaged teeth number between wheels 53*a* and 54*a* and that due to the variation of the engaged teeth number between wheels 53*b* and 54*b* appear alternatively one after another shifted by a half pitch. The variation of the tooth rigidity of the gear members 53, 54 is thus evened as a whole by combining the two variation, declining irregularity in the rotating movements, whereby unevenness in pitches of the image on the photosensitive drum 25 is eliminated.

Fifth Embodiment

Figure 9A:
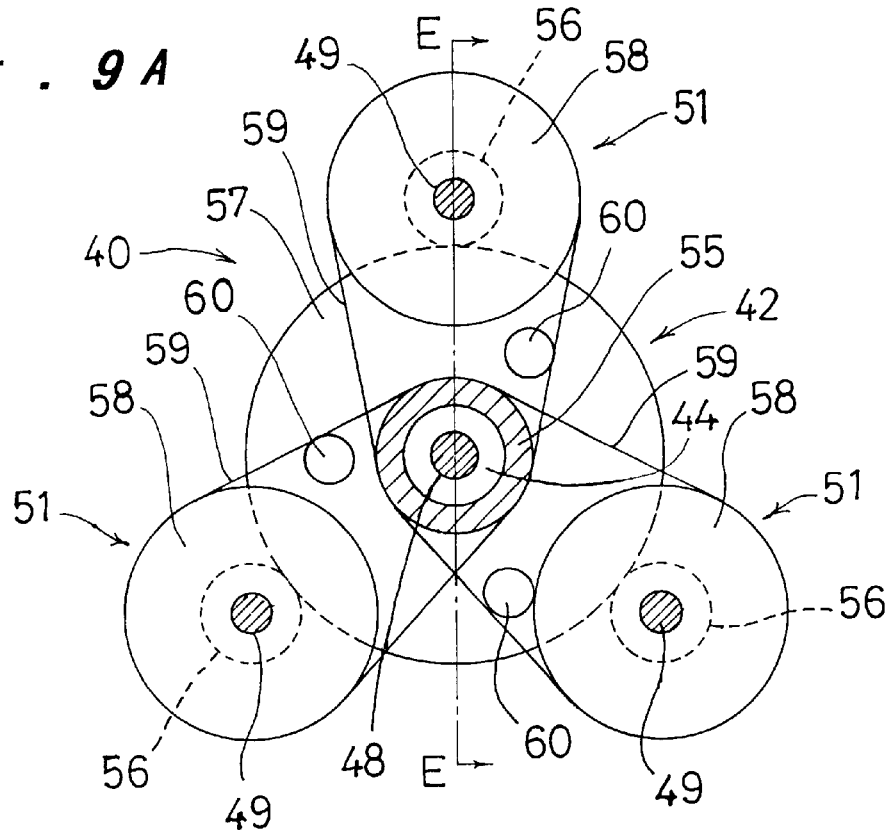
FIG. 9A is a plan view taken in the direction of the arrows along the line F—F of FIG. 9B.
Figure 9B:
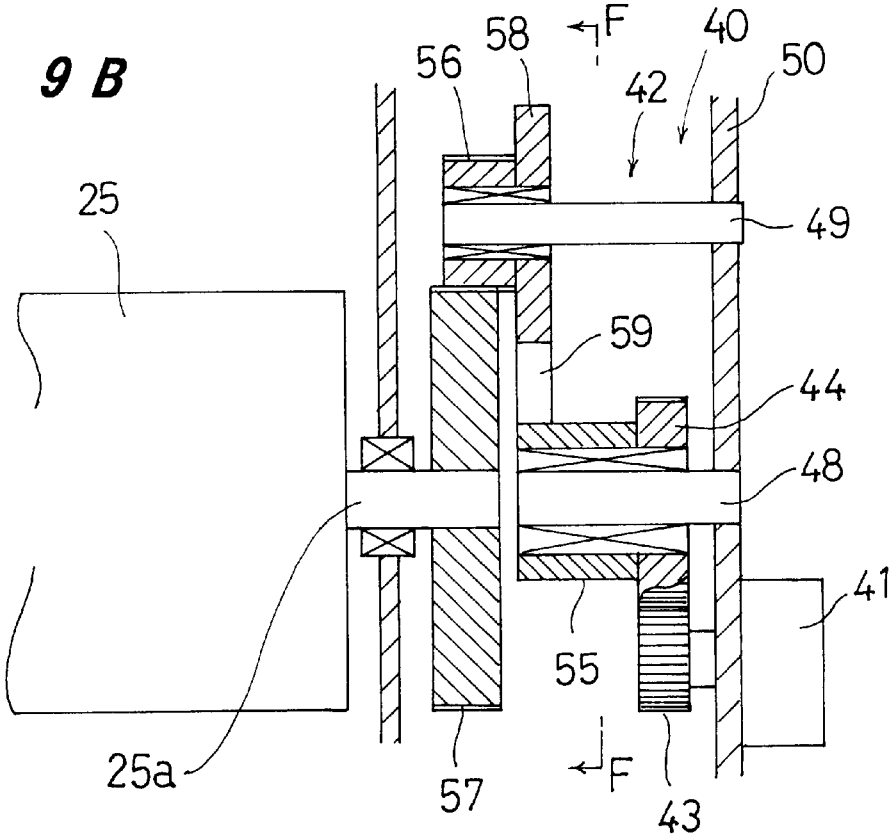
FIG. 9B is a longitudinal sectional side elevation view taken in the direction of the arrows along the line E—E of FIG. 9A, both showing a schematic structure of the driving mechanism according to a fifth embodiment of the present invention.

A fifth embodiment of the present invention is shown in FIGS. 9A and 9B, in which the drive transmission course 51 is constituted with a drive pulley 55, drive transmission belts 59, driven pulleys 58, transmission rollers 56, and a driven roller 57. More specifically, the drive pulley 55 is uniformly provided to the center gear 44, the driven roller 57 is provided in place of the driven gear 47, the transmission rollers 56 are substituted for the second transmission gears 46, each of which is closely contacted with the driven roller 57 and revolved there around, the driven pulleys 58 are uniformly provided to each of the transmission rollers 56, the drive transmission belts 59 such as a timing belt, a V-belt, or a flat belt are stretched between the drive pulley 55 and each of the driven pulleys 58. Reference numeral 60 denotes tension controlling rollers for the drive transmission belts 59.

In this embodiment, the drive transmission course 51 is constructed with friction rollers, pulleys, and drive transmission belts instead of toothed wheels as in the previously described embodiments, and thus has the same effects and advantages as described above. It is also possible to substitute friction rollers for all of the toothed wheels in each embodiment previously described.

Sixth Embodiment

A sixth embodiment of the present invention will be hereinafter described referring to FIGS. 10 and 11A–11C.

Figure 10:
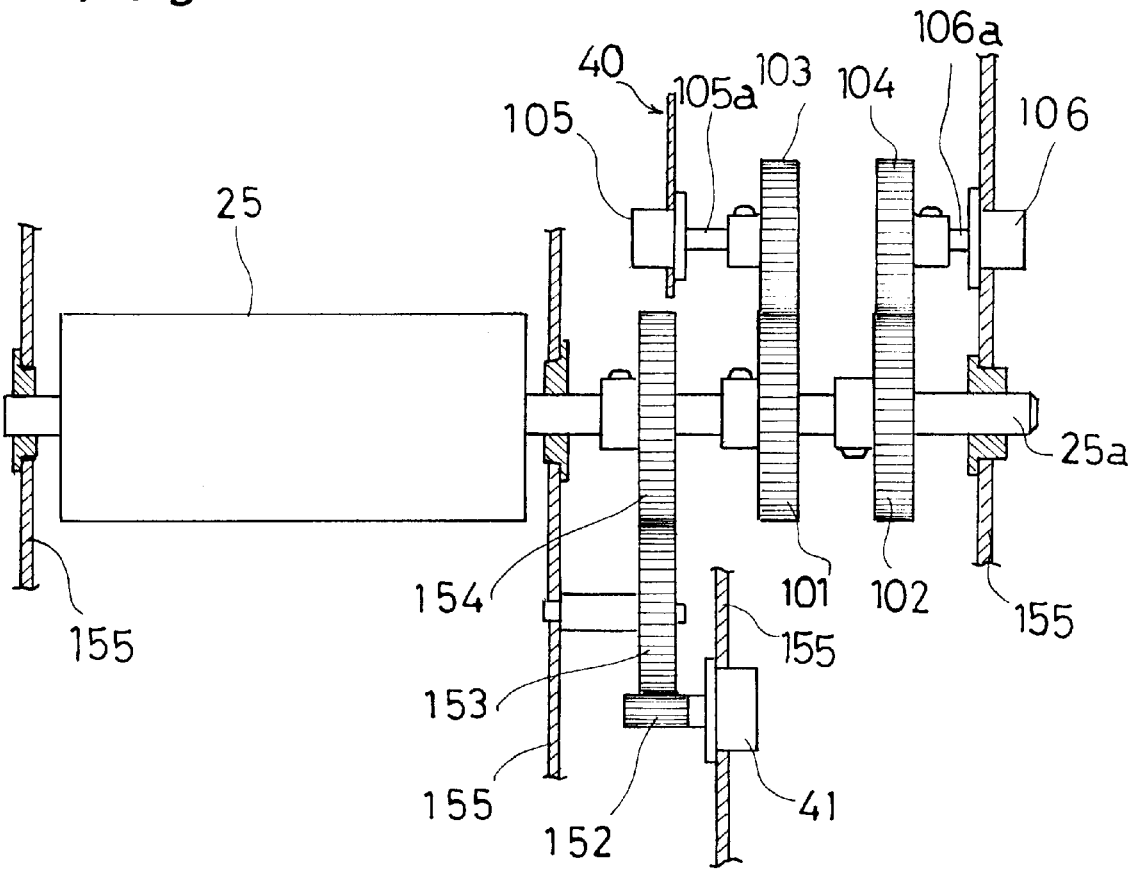
FIG. 10 is a front view showing a schematic structure of the driving mechanism according to a sixth embodiment of the present invention.

The photosensitive drum 25 is driven by the drive motor 41 as shown in FIG. 10. The driving mechanism 40 is comprised of a motor gear 152 directly connected to the drive motor 41, an idle gear 153 to which the rotation of the motor gear 152 is transmitted through a large and small reduction gears (not shown), and a drum gear 154 (corresponding to the driven gear 47 in the first embodiment) to which the rotation of the idle gear 153 is transmitted. Each of the gears is rotatably supported on a body frame 155 fixed to the machine body 11.

The transmission of rotation between these several gears causes irregularity in rotating movements of the photosensitive drum 25, which causes the position on the photosensitive drum 25 onto which a laser beam is directed for exposure to be slightly shifted, leading to uneven pitches of an monotone image. In case of forming a color image, each color cannot be accurately registered. In this embodiment, a monotone image is meant to be an image which is formed by one photosensitive member and one developing device, and a color image is meant to be an image which is formed by one photosensitive member and three or four developing devices or by three or four pairs of one photosensitive member and one developing device. In case of forming a color image, even a slight shift of colors may conspicuously damage the image, thus being not negligible.

In order to eliminate such irregularity in rotating movements, the inventors divided the causes of irregular rotation into two components; gear engagement and one cycle of rotation, and took different measures to separately counter these problems. The inventors also ascertained that the engagement between gears nearest to the photosensitive drum 25 most affects the rotation of the drum 25, thus taking a measure as hereinafter described.

Figure 11A:
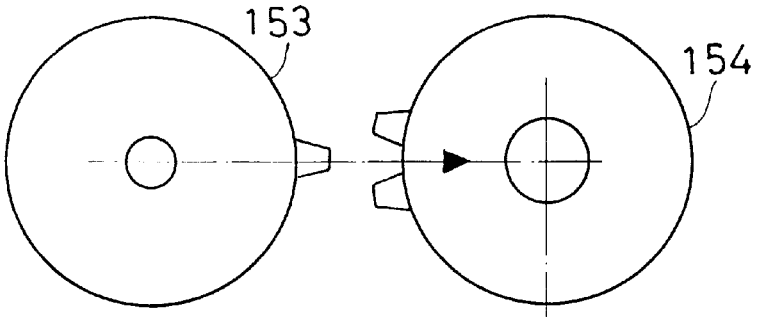
FIGS. 11A–11C show each of the engaged states between the gears.
Figure 11B:
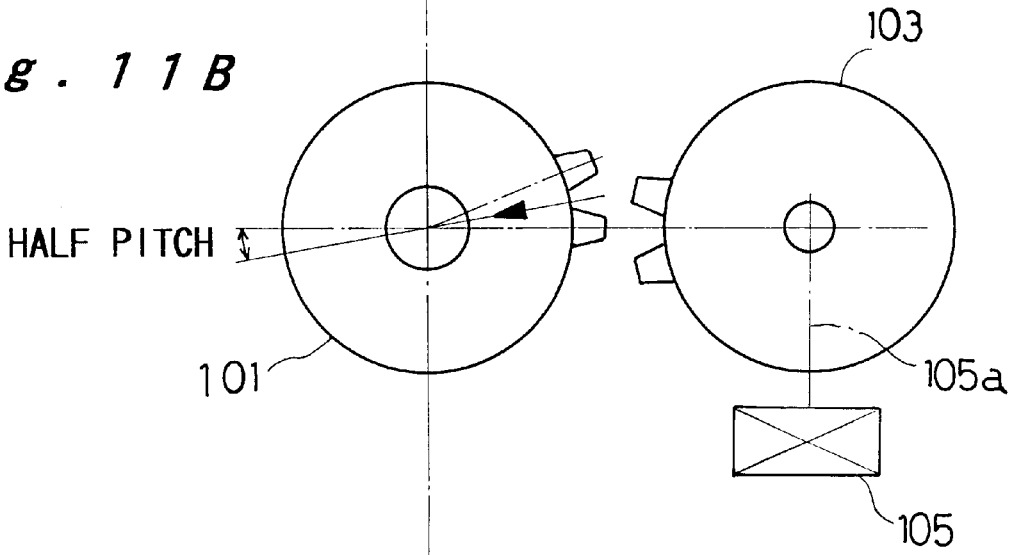

As shown in FIGS. 10 and 11A, the drum gear 154 is rotatably supported around the rotation shaft 25*a* of the photosensitive drum 25 and engaged with the idle gear 153. The rotation shaft 25*a* is further extended around which a load receiving gears 101, 102 fabricated identically with the drum gear 154 are connected. The load receiving gear 101 is engaged with a load transmission gear 103 which is of the same configuration as the idle gear 153 but shifted a half pitch with respect to the drum gear 154 as shown in FIG. 11B. The black triangle in FIG. 11B shows the same position as the corresponding position on the drum gear 154 of FIG. 11A. As shown, the timing of engagement between the load receiving gear 101 and the load transmission gear 103 is differed by half of the pitch with respect to the timing of engagement between the drum gear 154 and the idle gear 153 of FIG. 11A.

Figure 11C:
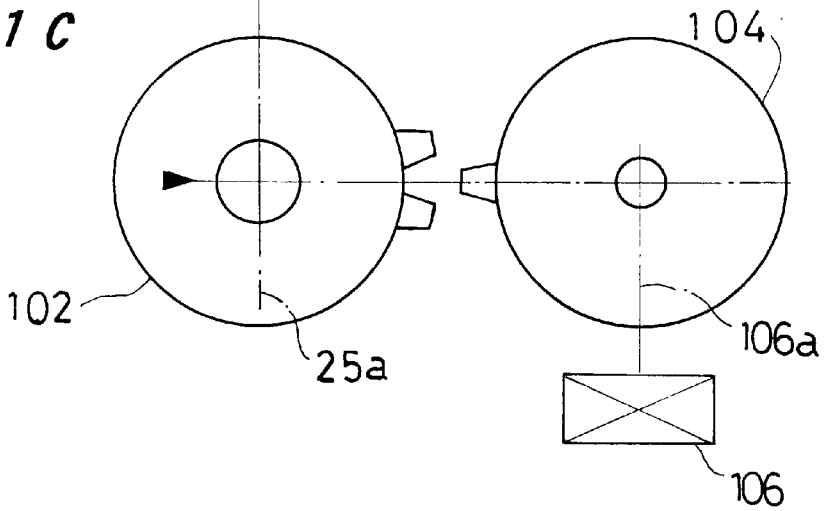

On the other hand, the load receiving gear 102 is engaged with a load transmission gear 104 which is the same configuration as the idle gear 153 but shifted at 180 degrees with respect to the drum gear 154 as shown in FIG. 11C. The black triangle in FIG. 11C shows the same position as corresponding position on the drum gear 154 of FIG. 11A. As shown, the timing of engagement between the load receiving gear 102 and the load transmission gear 104 is differed by 180 degrees with respect to that of the drum gear 154 and the idle gear 153. The load transmission gears 103, 104 are further mounted to rotation shafts 105*a*, 106*a* of brakes 105, 106 (serving as rotation resistance generating means), respectively.

The drum gear 154 and the idle gear 153 correspond to the pair of gears at the photosensitive drum 25 side. The load receiving gears 101, 102 can be fabricated identically with the drum gear 154 using the same mold, and the load transmission gears 103, 104 can be made identically with the idle gear 153 using the same mold.

Figure 12A:
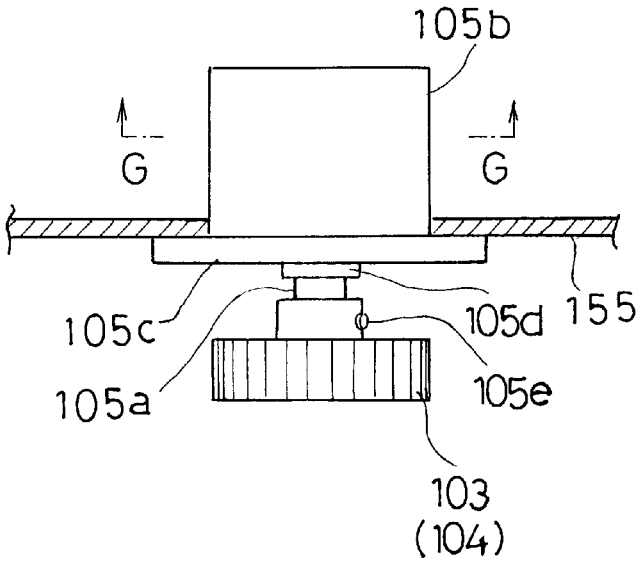
FIG. 12A is a plan view and FIG. 12B is a sectional view taken in the direction of the arrows along the line G—G of FIG. 12A, both showing a schematic structure of the brake.
Figure 12B:
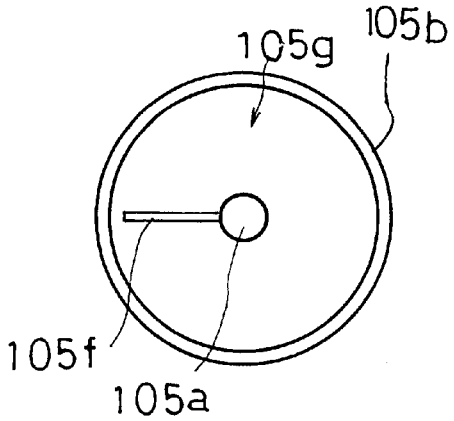

The brakes 105, 106 may preferably have an oil damper structure as shown in FIGS. 12A and 12B because of its favorable damping capacities. In FIG. 12A, the reference numeral 105*b* denotes the brake body, and the brake shaft 105*a* is projected via a seal bearing 105*d* from an opening at the center of a side plate 105*c* at one side of the brake body 105*b*. The side plate 105*c* is provided with a flange around its periphery, through which the brake body 105*b* is fixed to the body frame 155. At the projected end of the brake shaft 105*a* is the load transmission gear 103 (or 104) fixed with a pin 105*e*. FIG. 12B shows a cross sectional view cut along the line G—G in FIG. 12A of the brake body 105*b*. As shown, at least one rotating blade 105*f* is provided to the brake shaft 105*a*, which is rotatable around the brake shaft 105*a*, and immersed in oil 105*g* being sealed within the brake body 105*b* and having high viscosity.

Figure 13:
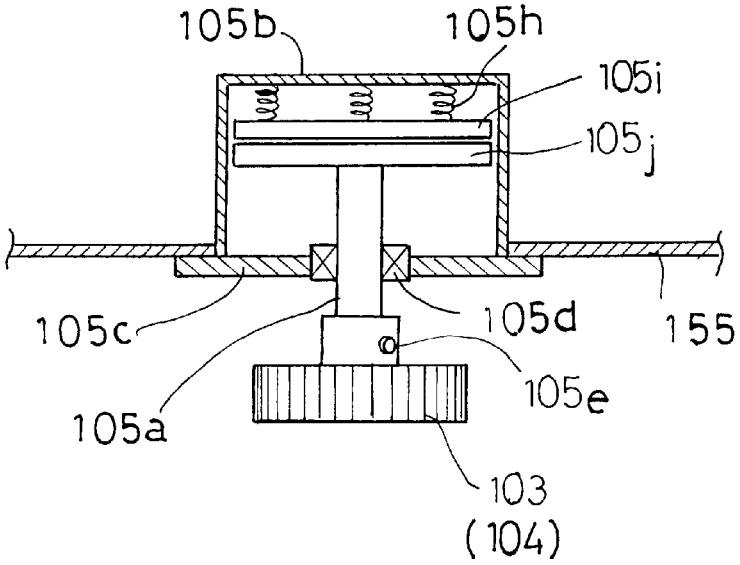
FIG. 13 is an explanatory view showing a schematic structure of the brake.

Alternatively, a friction plate structure as shown in FIG. 13 may be employed, which is simpler in configuration. As shown, a frictional plate 105*i* restricted with a spring 105*h* on an inner side of the brake body 105*b* is tightly pressed with another frictional plate 105*j* mounted to the brake shaft 105*a*.

Figure 14A:
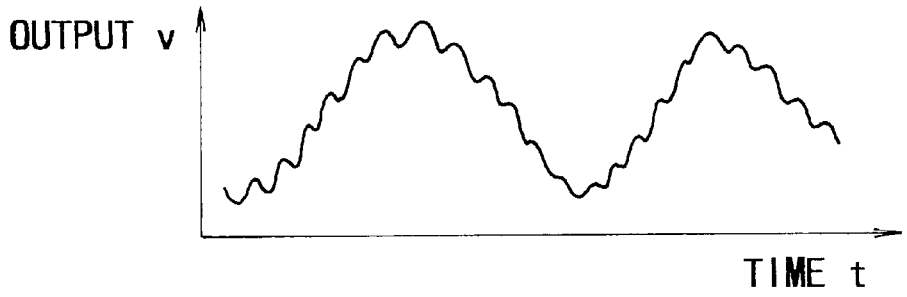
FIGS. 14A–14C are wave form charts showing vibration generated between the gears.

The driving mechanism 40 operates in a manner described below. The timing of engagement between the drum gear 154 and the idle gear 153 is preliminarily set at a given timing as shown in FIG. 11A. When the both gears 153, 154 are driven to rotate by the drive motor 41, the amplitude of vibration generated in rotation appears a wave as shown in FIG. 14A, which is combined with vibration caused by both components of gear engagement and one cycle of rotation. This vibration causes irregularity in rotation when transmitted to the photosensitive drum 25 as described in the description of prior arts.

In this embodiment, the load receiving gear 101 transmits rotation via the load transmission gear 103 to the brake 105, at such a timing as slightly differed by half a pitch with respect to the drum gear 154. The brake 105 of an oil damper structure generates rotation resistance according to rotation speed by stirring the oil 105*g* with the rotating blade 105*f* within the brake body 105*b*. If the brake 105 is constructed to have a friction plate structure, it similarly generates rotation resistance by the friction between the two plates 105*i* and 105*j*.

Figure 14B:
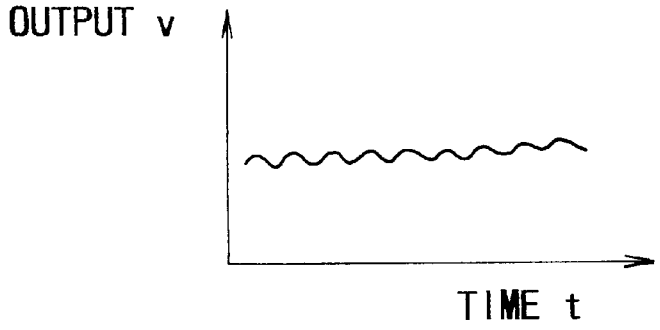

The wave form corresponding to the component of gear engagement has a high frequency and low amplitude as shown in FIG. 14B. Since there is a difference of half the pitch between the timing of engagement between the load receiving gear 101 and the load transmission gear 103 and that of the drum gear 154 and the idle gear 153, the wave form of FIG. 14B has a reverse phase with respect to the wave form of FIG. 14A due to the shifting of the phase by a half pitch. This rotation resistance acts on the photosensitive drum 25 via the load transmission gear 103 and the load receiving gear 101 as a reaction force, counterbalancing the vibration in FIG. 14A caused by the component of gear engagement. As there is substantially no time lag caused by torque control with a brake as in a prior art arrangement, the vibration at a high frequency area can be readily restricted, which was especially difficult for the prior art arrangement to reduce.

Figure 14C:
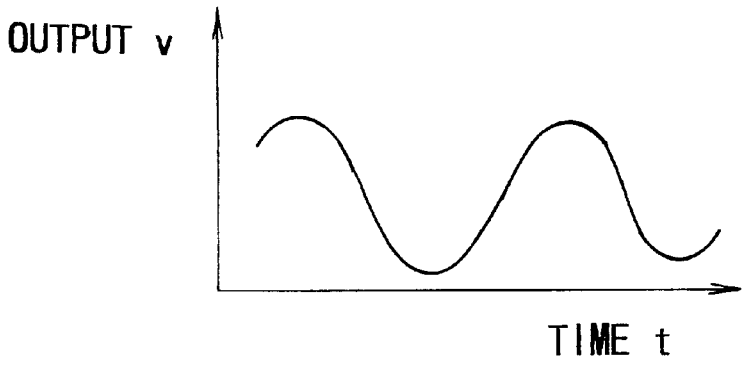

Also, in this embodiment, the load receiving gear 102 transmits rotation via the load transmission gear 104 to the brake 106, shifted by 180 degrees with respect to the timing of engagement between the drum gear 154 and the idle gear 153. The brake 106 generates rotation resistance according to rotation speed. The wave form corresponding to the component of one rotation of gear has a low frequency and high amplitude as shown in FIG. 14C. Since there is a difference of 180 degrees between the timing of engagement between the load receiving gear 102 and the load transmission gear 104 and that of the drive gear 154 and the idle gear 153, the vibration wave form of FIG. 14C has a reversed phase with respect to the vibration wave form caused by the component of one rotation of gear shown in FIG. 14A because of the shifting of the phase by 180 degrees. A reaction force of the rotation resistance acts on the rotation of the drum 25 via the load transmission gear 104 and the load receiving gear 102 as a load, counterbalancing the vibration caused by the component of one cycle of rotation in FIG. 14A. Accordingly, the vibration at a low frequency area can be readily restricted.

As set forth above, the driving mechanism of this embodiment is capable of decreasing the component of gear engagement as well as the component of one rotation of gear, both causing irregularity in rotation, and is also capable of decreasing the two components at the same time. This is achieved by only changing the amount of shifting the timing of each pair of gears in a simple structure without any complicated control circuit.

By reducing irregularity in rotation with such a simple arrangement, it is possible to conduct highly precise and accurate image formation.

Though it is described in this embodiment that the gears are mounted to the extended portion of the drum shaft 25*a* in the order of the drum gear 154, the load receiving gear 101, and the load receiving gear 102, the order of mounting gears may be variously modified. It is though preferable that the gears are disposed nearest possible with each other in order to ensure the tortional rigidity of the drum shaft 25*a*. Also, a combination of timing belts and pulleys may be substituted for the gears directly engaged with each other.

Seventh Embodiment

A seventh embodiment of the present invention will be hereinafter described referring to FIGS. 15–24.

Figure 15:
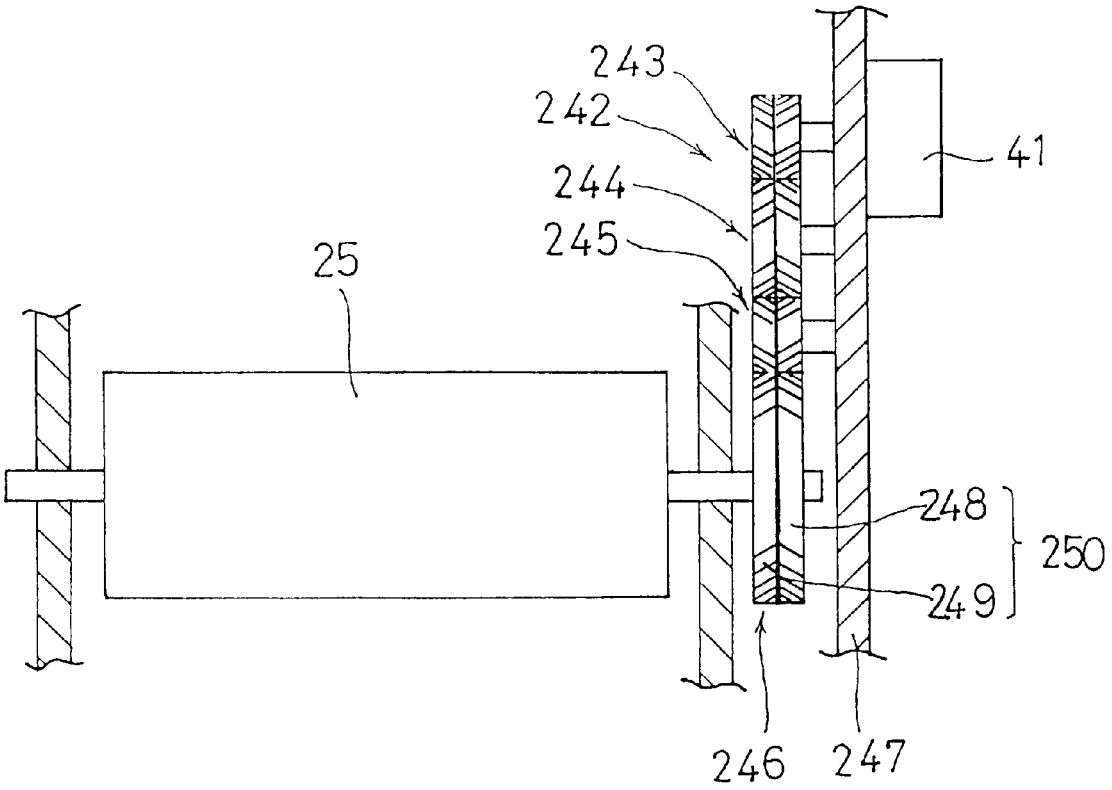
FIG. 15 is a schematic view showing a structure of the driving mechanism according to a seventh embodiment of the present invention.

The photosensitive drum 25 is driven by a drive motor 41 via a drive transmission system 242 as shown in FIG. 15. The drive transmission system 242 is comprised of a series of toothed wheels including a drive gear 243 fixed to the shaft of the drive motor 41, a first and a second idle gears 244, 245, and a driven gear 246 fixed to the shaft of the photosensitive drum 25. The reference numeral 247 denotes a side plate of the machine body 11.

When transmitting a drive force by rotation of these toothed wheels, the rigidity of the teeth engaged with each other between the gears 243–246 varies as the number of engaged teeth changes, which causes irregular movements of the gears and uneven rotation of the photosensitive drum 25. If the photosensitive drum 25 is unevenly rotated, the positions on the photosensitive drum 25 where the laser beam writes in image formation will be slightly shifted, causing unevenness in pitches of the image.

Figure 16A:
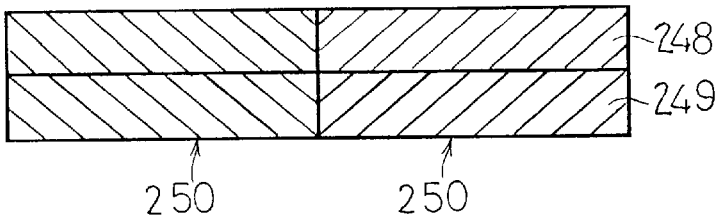
FIG. 16A shows an exemplary combination of a pair of toothed wheels.
Figure 16B:
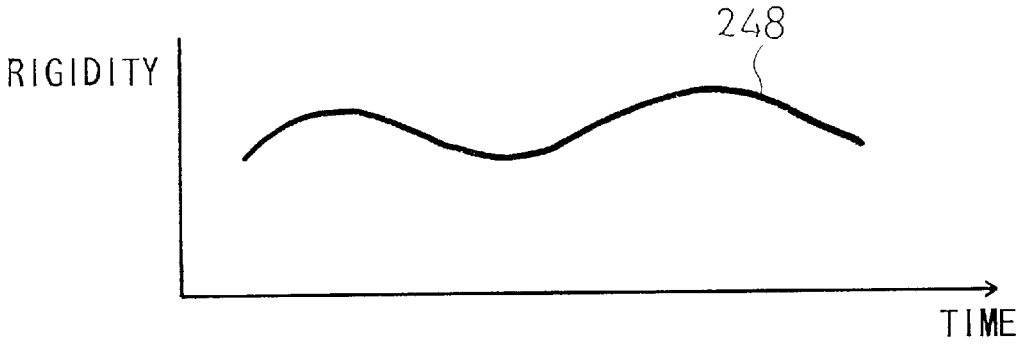
FIGS. 16B and 16C show changes in the rigidity of teeth of the toothed wheels engaged with each other as time passes.
Figure 16C:
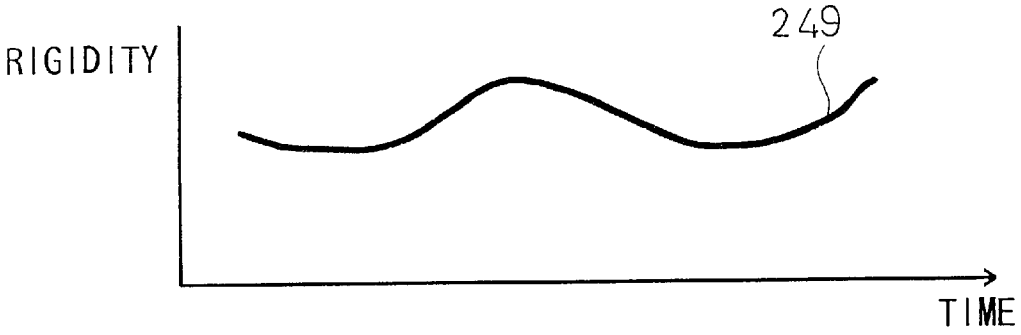

In order to prevent this, the gears 243–246 are respectively comprised of a gear member 250 consisting of two toothed wheels 248, 249 being combined together and having their teeth shifted by a half of the pitch with respect to each other as shown in FIG. 16A. By this arrangement, the variation of the tooth rigidity of the wheels 248 with the lapse of time and that of the wheels 249, which are due to the variation of the engaged teeth number, appear alternatively one after another shifted by a half pitch as can be seen from FIGS. 16B and 16C. The variation of the tooth rigidity of the gear member 250 is thus evened as a whole by combining the two variation, declining irregularity in the rotating movements, whereby unevenness in pitches of the image on the photosensitive drum 25 is eliminated.

Figure 17A:
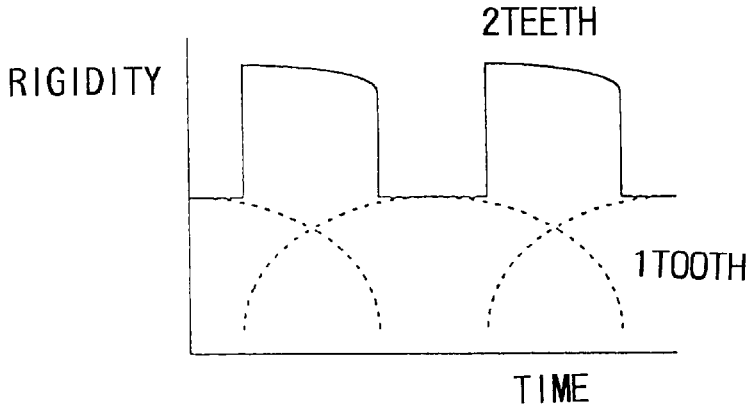
Fig. 17A Prior Art
FIGS. 17A and 17B show changes in the rigidity of teeth of spur wheels engaged with each other in a prior art arrangement and in this embodiment of the present invention, respectively.
Figure 17B:
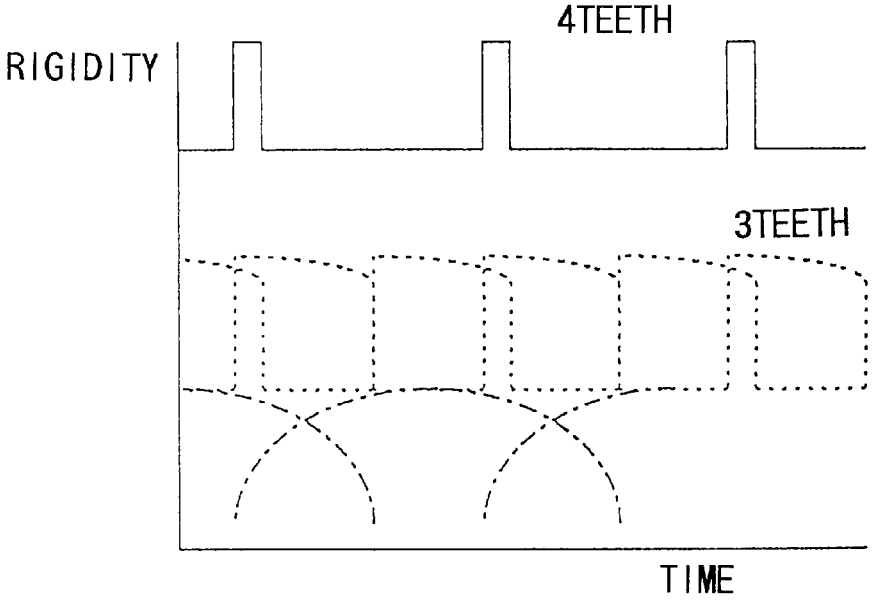

More particularly, when all of the gears 243–246 are spur wheels and respectively made of a single toothed wheel as in the prior art arrangement, the rigidity of teeth drops greatly in a cycle as shown in FIG. 17A. On the other hand, when all of the gears 243–246 are respectively comprised of the gear member 250 which is made by combining two toothed wheels 248, 249 with their teeth shifted by a half of the pitch, the rigidity of teeth is constantly kept above a certain level as shown in FIG. 17B.

Figure 18A:
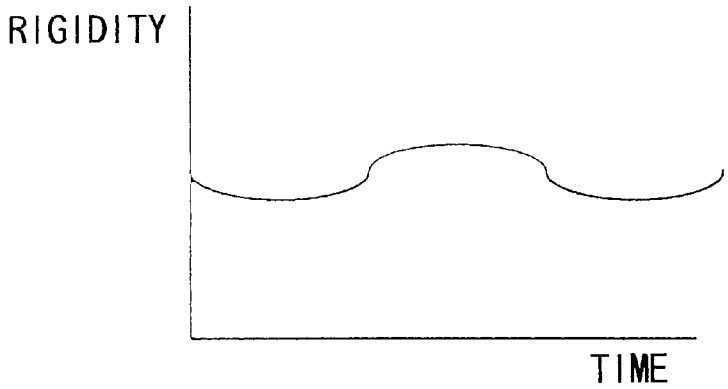
Fig. 18A Prior Art
FIGS. 18A and 18B show changes in the rigidity of teeth of helical gears engaged with each other in a prior art arrangement and in this embodiment of the present invention, respectively.
Figure 18B:
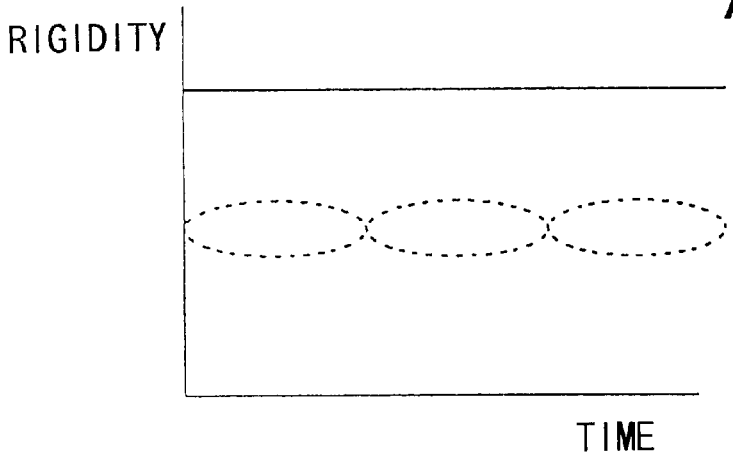

Similarly, when all of the gears 243–246 are helical gears and respectively made of a single toothed wheel as in the prior art arrangement, the rigidity of teeth drops, though relatively small, in a cycle as shown in FIG. 18A. On the other hand, when all of the gears 243–246 are respectively comprised of the gear member 250 which is made by combining two toothed wheels 248, 249 with their teeth shifted by a half of the pitch, the rigidity of teeth is kept substantially even above a certain level as shown in FIG. 18B.

Figures 19A, 19B:
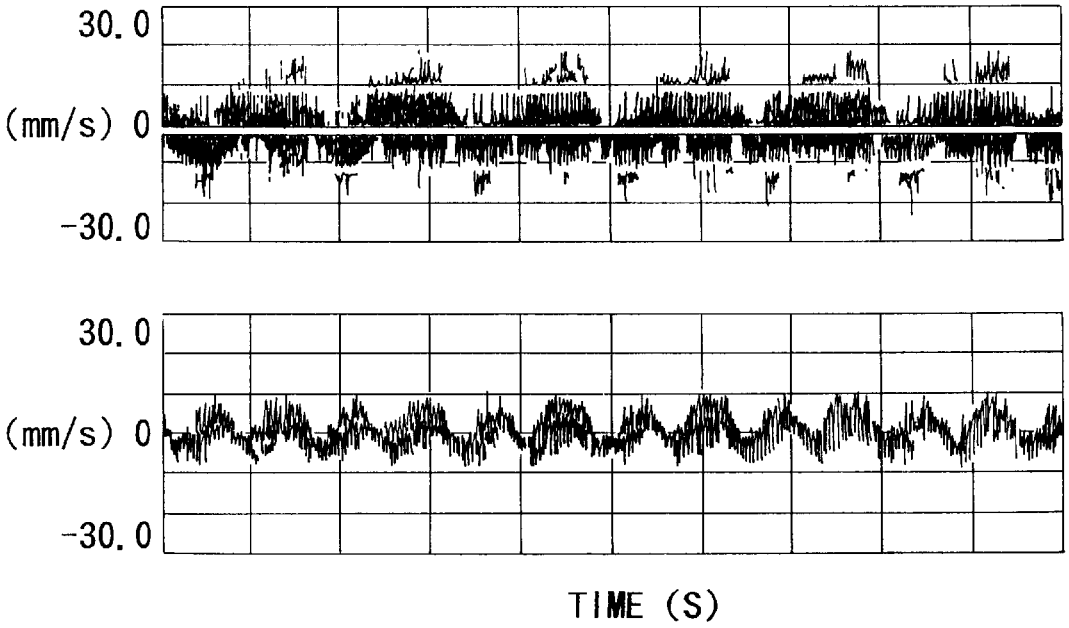
Fig. 19A Prior Art
FIGS. 19A and 19B show the variation in rotation speed of the photosensitive drum in a prior art arrangement and in this embodiment of the present invention, respectively.

FIGS. 19A and 19B show measurement results of variations in the speed of rotation of the photosensitive drum 25 in the prior art arrangement and in the above described arrangement of the present invention, respectively. As shown, the range of the variation in this embodiment is halved as compared with the prior art arrangement.

Specific examples of arrangement for the gear member will be hereinafter described referring to FIGS. 20 to 24.

Referring to FIG. 20A, two pairs of toothed wheels 248*a*, 249*a* and 248*b*, 249*b* are respectively coupled to a pair of support shafts 251*a*, 251*b* projected from the side plate 247, and fixed by screws 252*a*, 252*b*, thus constituting two gear members 250*a*, 250*b*, each being comprised of the toothed wheels 248*a*, 249*a* and 248*b*, 249*b* with their teeth shifted by a half pitch with respect to each other. More specifically, the wheel 248*a* is first coupled to the support shaft 251*a*, and the wheel 248*b*, while being engaged with the wheel 248*a*, is coupled to the support shaft 251*b*. Nextly, the wheel 249*a* is coupled to the support shaft 251*a* with its teeth shifted by a half pitch in relation to those of the wheel 248*a*, and the wheel 249*b*, while being engaged with the wheel 249*a*, is coupled to the support shaft 251*b*. Then, the toothed wheels 248*a* and 249*a* are fixed to each other by the screws 252*a*, and the toothed wheels 248*b* and 249*b* are fixed to each other by the screws 252*b*. The wheels may be fixed by pins instead of screws 252*a*, 252*b*. FIG. 20A shows an example of spur gear arrangement, while FIG. 20B shows an exemplary arrangement of helical gears.

The gear member 250 can be more readily assembled by sequentially coupling the separate toothed wheels 248, 249 to the support shafts 251*a*, 251*b* in the arrangement described above, as compared to the arrangement in which the gear member 250 is uniformly made and it is troublesome to couple the engaged gear members 250, 250 to the support shafts.

FIGS. 21A–21C show another arrangement of the gear member 250, in which the toothed wheels 248, 249 consist of toothed wheels 253 formed with the same mold to have an odd number of teeth, which are rotated at 180 degrees with respect to each other and combined together to construct the gear member 250 comprising two wheels with their teeth shifted with each other by a half pitch. As shown in FIGS. 21A and 21B, each wheel 253 has its axial hole 254 at the axial center thereof, and is provided with a pair of bosses 255 on either side of the axial hole 254 along the diameter thereof on one side face, as well as a pair of matching holes 256 on the other side face to receive the bosses 255. By combining two wheels formed with an identical mold and rotated at 180 degrees with each other as shown in FIG. 21C, the unevenness in one cycle of rotation of the gears caused by eccentricity of the gears at the time of manufacture can be effectively decreased.

More specifically, the velocity V of the gear on a pitch circle is expressed by $$(r-e)\omega<V<(r+e)\omega$$

in prior arts, while it is $$(r^2-e^2)^{1/2}\omega<V<(r+e)\omega$$

in this embodiment, where r is radius of the pitch circle, e is error between the center of the pitch circle and the center of rotation, and ω is angular velocity at the center of rotation, from which it is obvious that the variation in velocity on the pitch circle caused by eccentricity of the gears is effectively reduced. "The pitch circle" is meant to be an imaginative circle being concentric with the gear and defined by tracing points where the teeth of the gear are thickest.

FIGS. 22A–22C show another example of the gear arrangement, in which an annular rib 257 having a shorter diameter than the pitch circle are provided on both sides of the teeth 258 of the both toothed wheels 248, 249. Such rib 257 helps reduce the deflection of the dedendum 258*a* of the teeth 258 being engaged with other teeth. Since the rib 257 has a smaller diameter than the pitch circle, it does not obstruct the engagement of the gears. Thus, the deflection of the teeth 258 can be evenly reduced as well as the amplitude of vibration generated when the gears come to engage with each other can be decreased by the provision of the rib 257.

FIGS. 23A and 23B show another arrangement of the gear member, in which the toothed wheels 248, 249 are united together to constitute two gear members 250*a*, 250*b*, and one of the gear members 250*a* is provided with a rib 259 between the two wheels 248, 249, and the other gear member 250*b* is provided with a matching gap 260 between the gears 248, 249 to receive the rib 259. According to such arrangement, it can be prevented that the teeth of the gear members 250*a*, 250*b* having different phases get caught with each other by errors and burrs created in a forming process of teeth, whereby irregular rotation is eliminated. In addition to the rib 259 between the toothed wheels 248, 249 provided to one of the gear members 250*a*, the other gear member 250*b* is also provided with another rib 261 on both outer sides of the wheels 248, 249 as shown in FIGS. 23A and 23B, which helps reduce the deflection of the teeth and to diminish the amplitude of vibration at the time of engagement of teeth.

FIG. 24A shows another example of gear member arrangement, in which a damping member 262 made of a resilient material such as rubber is disposed between the toothed wheels 248, 249 of the gear member 250. According to such arrangement, the vibration of the teeth of each wheel 248, 249 can be swiftly abated as shown in FIG. 24C as compared with the case in the prior art arrangement shown in FIG. 24B, thus preventing irregular rotation of gears.

Although the embodiments of the present invention have been described as being implemented in a laser printer, it is possible to apply the present invention to any apparatuses which form images with the use of electrophotographic processes, and for example, may be favorably incorporated in an analog copying machine. Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A driving mechanism for rotating an image holding member comprising:

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member;

wherein the last stages of each drive transmission course and the receiving member respectively comprises two toothed wheels coaxially combined together.

2. A driving mechanism according to claim 1, wherein connecting positions of the last stage of each drive transmission course to the receiving member are disposed at an equal interval around a shaft of the receiving member.

3. A driving mechanism according to claim 1, wherein the drive transmission system includes a central transmission member disposed coaxially with the rotating shaft of the image holding member, from which each of the drive transmission courses diverts.

4. A driving mechanism according to claim 1, wherein the two toothed wheels are combined together with their teeth shifted by half a pitch in relation to each other.

5. A driving mechanism according to claim 1, wherein the last stage of each drive transmission course and the receiving member are engaged with each other with their teeth shifted by 1/n of a pitch in relation to each other when the number of diverged drive transmission courses is n.

6. A driving mechanism according to claim 3, wherein the last stages of each drive transmission course and the receiving member are friction rollers, and the central transmission member and each of the drive transmission courses are linked by a belt.

7. An image forming apparatus, comprising:

an image holding member;

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member, wherein the last stages of each drive transmission course and the receiving member respectively comprises two toothed wheels coaxially combined together.

8. An image forming apparatus according to claim 7, wherein connecting positions of the last stage of each drive transmission course to the receiving member are disposed at an equal interval around a shaft of the receiving member.

9. An image forming apparatus according to claim 7, wherein the drive transmission system includes a central transmission member disposed coaxially with the rotating shaft of the image holding member, from which each of the drive transmission courses diverts.

10. A driving mechanism according to claim 7, wherein the two toothed wheels are combined together with their teeth shifted by half a pitch in relation to each other.

11. A driving mechanism according to claim 7, wherein the last stage of each drive transmission course and the receiving member are engaged with each other with their teeth shifted by 1/n of a pitch in relation to each other when the number of diverged drive transmission courses is n.

12. An image forming apparatus according to claim 9, wherein the last stages of each drive transmission course and the receiving member are friction rollers, and the central transmission member and each of the drive transmission courses are linked by a belt.

13. A driving mechanism for rotating an image holding member, comprising:

a drive source for driving the image holding member to rotate;

a drive transmission system for transmitting a drive force from the drive source to the image holding member, including a first pair of gears comprised of a toothed wheel disposed on a rotating shaft of the image holding member and another toothed wheel engaged therewith; and a resistance giving mechanism for providing a resistance force to a rotation of the image holding member through a second pair of gears comprised of toothed wheels fabricated to have an identical configuration with that of the first pair of gears; wherein the toothed wheels of the second pair of gears are brought to engagement at a timing lagged by a given amount from that of the first pair of gears.

14. A driving mechanism according to claim 13, wherein the given amount is half a pitch.

15. A driving mechanism according to claim 13, wherein the given amount is 180 degrees.

16. A driving mechanism according to claim 13, wherein the resistance giving mechanism generates resistance with an oil damper system.

17. A driving mechanism for rotating an image holding member, comprising:

a drive source for driving the image holding member to rotate;

a drive transmission system for transmitting a drive force from the drive source to the image holding member, including a first pair of gears comprised of a toothed wheel disposed on a rotating shaft of the image holding member and another toothed wheel engaged therewith;

a first resistance giving mechanism for providing a resistance force to a rotation of the image holding member through a second pair of gears comprised of toothed wheels fabricated to have an identical configuration with that of the first pair of gears; and a second resistance giving mechanism for providing a resistance force to the rotation of the image holding member through a third pair of gears comprised of toothed wheels fabricated to have an identical configuration with that of the first pair of gears, wherein the toothed wheels of the second pair of gears are brought to engagement at a timing lagged by half a pitch from that of the first pair of gears, and the toothed wheels of the third pair of gears are brought to engagement at a timing lagged by 180 degrees from that of the first pair of gears.

18. A driving mechanism according to claim 17, wherein the first and second resistance giving mechanisms generate resistance with an oil damper system.

19. An image forming apparatus, comprising:

an image holding member;

a drive source for driving the image holding member to rotate;

a drive transmission system for transmitting a drive force from the drive source to the image holding member, including a first pair of gears comprised of a toothed wheel disposed on a rotating shaft of the image holding member and another toothed wheel engaged therewith; and a resistance giving mechanism for providing a resistance force to a rotation of the image holding member through a second pair of gears comprised of toothed wheels fabricated to have an identical configuration with that of the first pair of gears, wherein the toothed wheels of the second pair of gears are brought to engagement at a timing lagged-by a given amount from that of the first pair of gears.

20. An image forming apparatus according to claim 19, wherein the given amount is half a pitch.

21. An image forming apparatus according to claim 19, wherein the given amount is 180 degrees.

22. An image forming apparatus according to claim 19, wherein the resistance giving mechanism generates resistance with an oil damper system.

23. An image forming apparatus, comprising:

an image holding member;

a drive source for driving the image holding member to rotate;

a drive transmission system for transmitting a drive force from the drive source to the image holding member, including a first pair of gears comprised of a toothed wheel disposed on a rotating shaft of the image holding member and another toothed wheel engaged therewith;

a first resistance giving mechanism for providing a resistance force to a rotation of the image holding member through a second pair of gears comprised of toothed wheels fabricated to have an identical configuration with that of the first pair of gears; and a second resistance giving mechanism for providing a resistance force to the rotation of the image holding member through a third pair of gears comprised of toothed wheels fabricated to have an identical configuration with that of the first pair of gears, wherein the toothed wheels of the second pair of gears are brought to engagement at a timing lagged by half a pitch from that of the first pair of gears, and the toothed wheels of the third pair of gears are brought to engagement at a timing lagged by 180 degrees from that of the first pair of gears.

24. An image forming apparatus according to claim 23, wherein the first and second resistance giving mechanisms generate resistance with an oil damper system.

25. A driving mechanism for rotating an image holding member, comprising:

a drive source for driving the image holding member to rotate;

a drive transmission system for transmitting a drive force from the drive source to the image holding member, including a pair of gears comprised of a first gear member consisting of two toothed wheels coaxially combined together with their teeth shifted by half a pitch in relation to each other and a second gear member consisting of two toothed wheels respectively engaged with the two toothed wheels of the first gear member, and said two toothed wheels of the second gear member being coaxially combined together with their teeth shifted by half a pitch in relation to each other.

26. A driving mechanism according to claim 25, wherein each of the toothed wheels of the first and second gear members are formed with the same mold and have an odd number of teeth, and the two toothed wheels of the both gear members are respectively united together with their phases shifted by 180 degrees.

27. A driving mechanism according to claim 25, wherein at least one of the first and second gear members has a rib being smaller than a pitch circle on both outer sides of the toothed wheels.

28. A driving mechanism according to claim 25, wherein the first gear member is provided with a rib between the two toothed wheels and the second gear member has a gap between the two toothed wheels for receiving the rib.

29. A driving mechanism according to claim 28, wherein the two toothed wheels of the second gear member respectively have a rib on one side thereof opposite to a side where the gap is provided.

30. A driving mechanism according to claim 25, wherein at least one of the first and the second gear members is provided with a damping member between the two toothed wheels for reducing vibration.

31. An image forming apparatus, comprising:

an image holding member;

a drive source for driving the image holding member to rotate; and a drive transmission system for transmitting a drive force from the drive source to the image holding member, including a pair of gears comprised of a first gear member consisting of two toothed wheels coaxially combined together with their teeth shifted by half a pitch in relation to each other, and a second gear member consisting of two toothed wheels respectively engaged with the two toothed wheels of the first gear member, and said two toothed wheels of the second gear member being coaxially combined together with their teeth shifted by half a pitch in relation to each other.

32. An image forming apparatus according to claim 31, wherein each of the toothed wheels of the first and second gear members are formed with the same mold and have an odd number of teeth, and the two toothed wheels of the both gear members are respectively united together with their phases shifted by 180 degrees.

33. An image forming apparatus according to claim 31, wherein at least one of the first and second gear members has a rib being smaller than a pitch circle on both outer sides of the toothed wheels.

34. An image forming apparatus according to claim 31, wherein the first gear member is provided with a rib between the two toothed wheels and the second gear member has a gap between the two toothed wheels for receiving the rib.

35. An image forming apparatus according to claim 34, wherein the two toothed wheels of the second gear member respectively have a rib on one side thereof opposite to a side where the gap is provided.

36. An image forming apparatus according to claim 31, wherein at least one of the first and the second gear members is provided with a damping member between the two toothed wheels for reducing vibration.

37. A driving mechanism for rotating an image holding member comprising:

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member, wherein all of the last stages of each drive transmission course and the receiving member are toothed wheels, and wherein the last stage of each drive transmission course and the receiving member are engaged with each other with their teeth shifted by 1/n of a pitch in relation to each other when the number of diverged drive transmission courses is n.

38. A driving mechanism for rotating an image holding member comprising:

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member, wherein the drive transmission system includes a central transmission member disposed coaxially with the rotating shaft of the image holding member, from which each of the drive transmission courses diverges, and wherein the last stages of each drive transmission course and the receiving member are friction rollers, and the central transmission member and each of the drive transmission courses are linked by a belt.

39. An image forming apparatus, comprising:

an image holding member;

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member, wherein all of the last stages of each drive transmission course and the receiving member are toothed wheels, and wherein the last stage of each drive transmission course and the receiving member are engaged with each other with their teeth shifted by 1/n of a pitch in relation to each other when the number of diverged drive transmission courses is n.

40. An image forming apparatus, comprising:

an image holding member;

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member, wherein the drive transmission system includes a central transmission member disposed coaxially with the rotating shaft of the image holding member, from which each of the drive transmission courses diverges, and wherein the last stages of each drive transmission course and the receiving member are friction rollers, and the central transmission member and each of the drive transmission courses are linked by a belt.

41. A driving mechanism for rotating an image holding member comprising:

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member;

wherein the last stages of each drive transmission course and the receiving member respectively comprise n toothed wheels coaxially combined together, n being an integer more than one, and wherein the n two toothed wheels are combined together with their teeth shifted by 1/n of a pitch in relation to each other.

42. An image forming apparatus, comprising:

an image holding member;

a drive source for driving the image holding member to rotate; and a drive transmission system for transmitting a drive force from the drive source to the image holding member, including at least two diverged drive transmission courses, each course being connected at a last stage thereof to a receiving member disposed on a rotating shaft of the image holding member, wherein the last stages of each drive transmission course and the receiving member respectively comprise n toothed wheels coaxially combined together, n being an integer more than one, and wherein the n toothed wheels are combined together with their teeth shifted by 1/n of a pitch in relation to one another.

43. A driving mechanism for rotating an image holding member, comprising:

a drive source for driving the image holding member to rotate; and a drive transmission system for transmitting a drive force from the drive source to the image holding member, including a pair of gears comprised of a first gear member consisting of n toothed wheels coaxially combined, n being an integer more than one, with their teeth shifted by 1/n of a pitch in relation to one another, and a second gear member consisting of n toothed wheels respectively engaged with the n toothed wheels of the first gear member, and said n toothed wheels of the second gear member being coaxially combined with their teeth shifted by 1/n of a pitch in relation to one another.

44. An image forming apparatus, comprising:

an image holding member;

a drive source for driving the image holding member to rotate; and a drive transmission system for transmitting a drive force from the drive source to the image holding member, including a pair of gears comprised of a first gear member consisting of n toothed wheels coaxially combined, n being an integer more than one, with their teeth shifted by 1/n of a pitch in relation to one another, and a second gear member consisting of n toothed wheels respectively engaged with the n toothed wheels of the first gear member, and said n toothed wheels of the second gear member being coaxially combined with their teeth shifted by 1/n of a pitch in relation to one another.

* * * * *